US005735146A

United States Patent [19]

Taplin

[11] Patent Number: 5,735,146

[45] Date of Patent: Apr. 7, 1998

[54] LOCKING DEVICE FOR CAM ROD LOCKS

[76] Inventor: Gerald N. Taplin, 8801 Ampezo Trail, Austin, Tex. 78749

[21] Appl. No.: 882,919

[22] Filed: Jun. 26, 1997

[51] Int. Cl.[6] ..... E05B 63/14

[52] U.S. Cl. ..... 70/56; 70/121; 70/123; 70/212; 70/417; 292/205; 292/DIG. 32

[58] Field of Search ..... 70/54–56, 84, 70/103, 114–117, 121–123, 212, 417, DIG. 64, DIG. 65; 292/205, 218, DIG. 32

[56] References Cited

U.S. PATENT DOCUMENTS

| | | | |
|---|---|---|---|
| 510,181 | 12/1893 | Mallory | 292/218 |
| 2,592,647 | 4/1952 | Black | 292/218 |
| 3,656,789 | 4/1972 | Ray | 70/417 X |
| 3,863,471 | 2/1975 | Keller-Volper | 70/116 |
| 4,627,248 | 12/1986 | Haworth | 292/218 X |
| 4,742,701 | 5/1988 | Scavetto | 292/DIG. 32 X |
| 4,883,294 | 11/1989 | Goodspeed | 70/417 X |

FOREIGN PATENT DOCUMENTS

| | | | |
|---|---|---|---|
| 1553598 | 4/1970 | Germany | 70/116 |

*Primary Examiner*—Lloyd A. Gall
*Attorney, Agent, or Firm*—John E. Vandigriff

[57] ABSTRACT

The invention is a cam locking rod devices for securing doors on intermodal cargo containers, semi-trailers, utility trailers, trucks, and other similar cargo storage compartments. The lock rod device is used in conjunction with a rotatable cam lock rod, having cam locks on each end, mounted on a container door for securing the container door in a locked condition. A locking cylinder, through which the cam lock rod extends, has at least one locking projection thereon which interacts with at least one projection on a sliding latch, which when intermeshed prevents rotation of the cam lock rod. A pad lock is used in conjunction with the sliding latch to lock projections on the locking cylinder and slide latch in a meshed position which prevents rotation of the cam lock rod.

14 Claims, 21 Drawing Sheets

FIG. 20
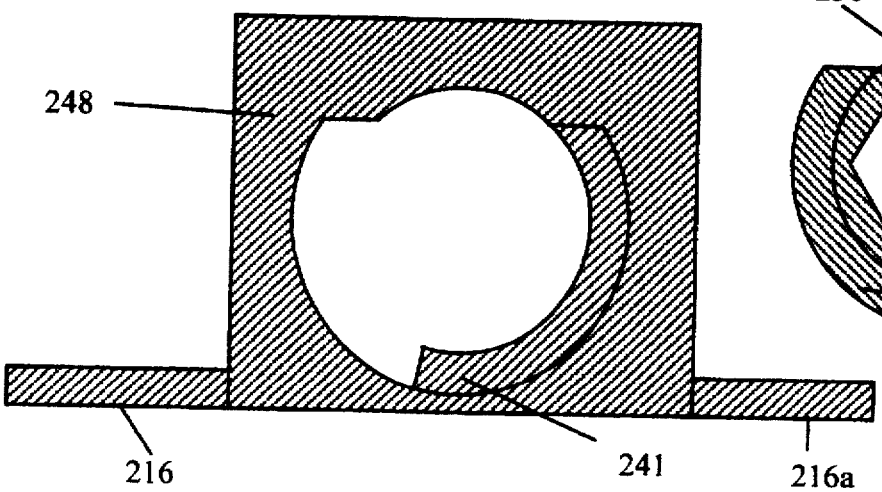
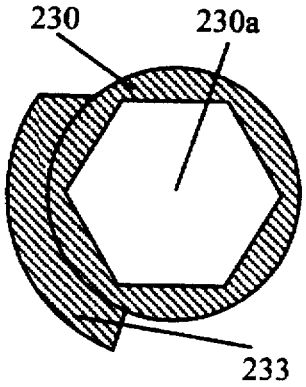
FIG. 21
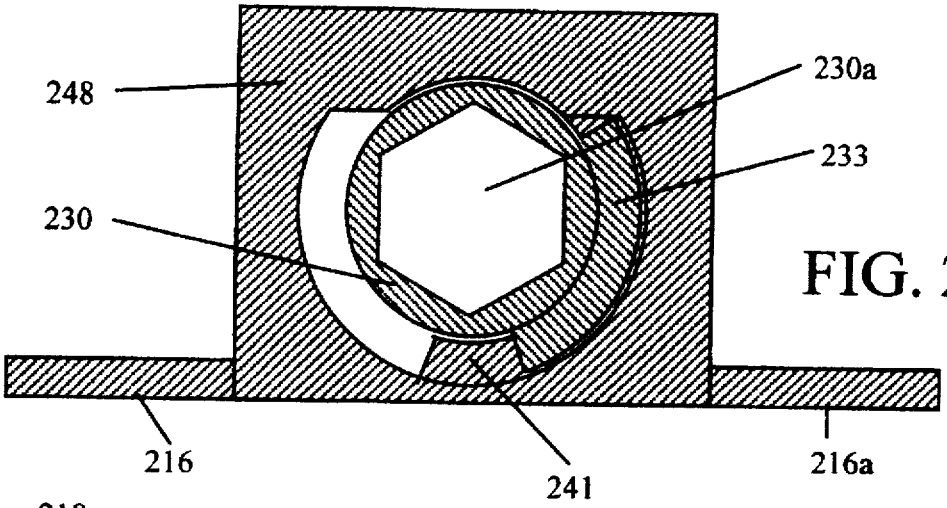
FIG. 22
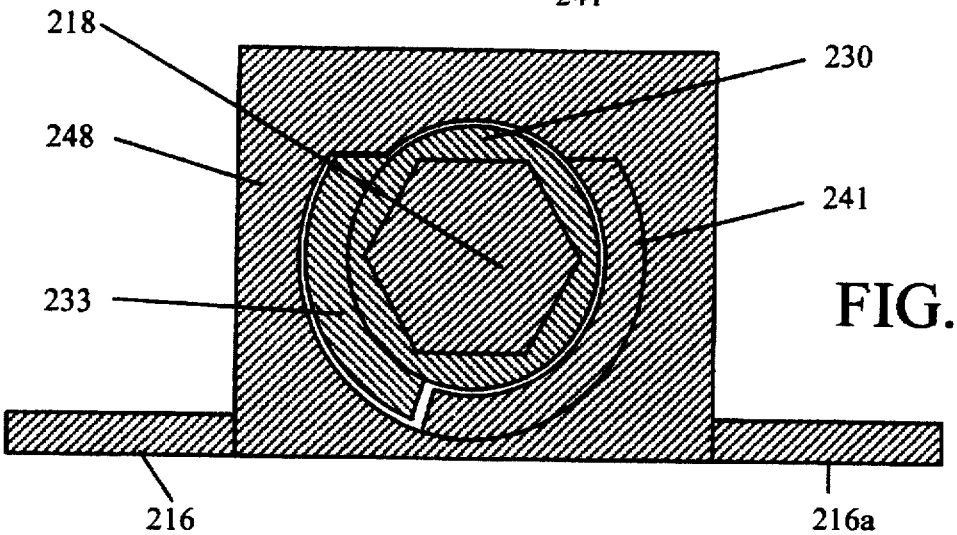
FIG. 23

LOCKING DEVICE FOR CAM ROD LOCKS

FIELD OF THE INVENTION

This invention relates to cam lock rod devices for securing doors on intermodal cargo containers, semi-trailers, utility trailers, and trucks; and more specifically to a security lock system for cam lock devices.

BACKGROUND OF THE INVENTION

Large hinged doors on cargo containers and semi-trailers are commonly fitted with door latching hardware referred to as cam lock rods. U.S. Pat. No. 934,933 to Posson (1909) entitled Door Operating Device, discloses basically the cam lock rod device still in use today. It is a simple design that is easy to use and maintain; and it is relatively inexpensive to manufacture and install. The design allows a single operator to not only latch large doors at both the top and bottom; but also to easily close doors tightly enough to compress elastic weather seals around the door edges to produce a water resistant closure.

The cam lock rod device typically consists of a long rod attached to the outside of a hinged door at several points with a pillow block type of bearing. Each end of the long rod extends slightly past the edge of the door, and is fitted with a cam device. A detent for receiving each cam is securely attached to the lower sill and upper door frame and each is positioned so that the lock rod cams may easily be inserted as the hinged door is swung into the nearly closed position. A hinged handle is attached to, and is used to rotate the cam lock rod.

One of the more useful features of the cam lock rod door closure device may be observed at the point where a hinged door is nearly closed and has just begun to compress the elastic door seals. This is the position where the greatest resistance to further movement occurs. The combined mechanical advantage of the lock rod handle, functioning as a lever, and the cams at each end of the lock rod, makes it relatively easy to overcome the resistance of the elastic weather seals as the door is completely closed, sealed, and secured.

Due to the design of intermodal cargo containers and the manner in which they are handled, it is necessary that cargo container locking and latching hardware have a low profile. Cargo containers are subject to being butted end to end on board container ships and in storage areas. Each end of a cargo container has four corner castings which function as bumpers and are the furthermost extensions of the length of a container. Locking or latching hardware should not extend past the plane of these corner castings, since anything that does is likely to either be damaged by or cause damage to an abutted container.

The cam lock rod door closure device was originally designed to facilitate the closing and sealing of tightly fitting, thick, and heavily insulated, hinged doors on refrigerated rail cars, transporting perishable food commodities. Security was not a major consideration. A hasp attached to the door was used in conjunction with a padlock to secure the lock rod handle in the closed position and prevent unauthorized opening of the door. Today the cam lock rod door closure device is commonly used on containers and trailers carrying much more valuable cargo, and cargo security has become a greater concern.

Various approaches have been taken to make doors equipped with cam lock rods more secure. Several patents disclose hardware to secure cam lock rods against unauthorized unlatching, while other patents describe security devices which do not incorporate the cam lock rods as part of the security system. U.S. Pat. No. 5,035,127 discloses a hinged cross bar which spans across cam lock rods on adjacent doors. A large housing protects a straight, shackled padlock. U.S. Pat. No. 4,760,720 discloses a removable cylindrical housing which in one embodiment, may be used to protect a padlock and hasp securing a cam lock rod handle in the latched position. U.S. Pat. No. 3,736,016 discloses a large box which is shown in one embodiment mounted over a cam lock rod. The box protects a padlock and a pair of hasp staples mounted near the meeting edges of two hinged doors. While each of these three devices provides an increased level of security when used in conjunction with cam lock rods, they are not suitable for use on most existing intermodal cargo containers, since they would likely project past the plane of the corner castings. U.S. Pat. Nos. 4,581,907, and 4,898,008 describe hasp staple, and padlock shackle, shielding devices which exhibit a low profile when used as disclosed; however, each could be circumvented by severing the cam lock rod handle, between the hasp and the cam lock rod.

Four U.S. Pat. Nos. 5,145,222, 4,372,136 5,284,036, and 4,389,862 disclose devices which function by clasping adjacent cam lock rods mounted nearest to the meeting edges of adjacent doors, and spanning between them. All four of these devices are adjustable, so that they may accommodate a variety of spacing between adjacent cam lock rods. The device disclosed in U.S. Pat. No. 5,145,222 uses a cylinder lock, while the other three use padlocks. Each of the four devices provides some form of protection for the lock mechanism. The device disclosed in U.S. Pat. No. 5,284,036 also includes additional shielding to protect the cam lock rod handle. Two of the devices, U.S. Pat. Nos. 5,284,036, and 4,389,862 exhibit a low profile when used as disclosed, in conjunction with cam lock rods, and appear to be usable on intermodal cargo containers.

Of the above cited security devices that would be suitable for use on intermodal cargo containers, all utilize the cam locking rods as an integral part of the locking system. However, this presents a problem, since typically there is enough space between the lock rod and the door on which it is mounted, to allow a chain or cable to be forced under, and attached to the lock rod. Then by applying sufficient force to the chain or cable, the entire cam lock rod mechanism may be torn from its mounting; effectively circumventing the locking device.

SUMMARY OF THE INVENTION

The invention is a cam lock rod device for securing doors on intermodal cargo containers, semi-trailers, utility trailers, and trucks. The device is a security locking device in which a locking cylinder is secured to and in line with the cam lock rod that turns the cam locks which secure the doors of the container. The locking cylinder has projections which are aligned with projections on a slide arm, which is moved into a locking position when a padlock is closed. The projections on the slide arm block movement of the projections on the locking cylinder and prevent the cam lock rod and cam locks from rotating and unlocking the container doors. A protective cover is secured over the locking mechanism and the cam lock rod to prevent the insertion of a cable or chain or prying tool under the cam lock rod.

BRIEF DESCRIPTION OF THE DRAWINGS

FIGS. 20–23 show the locking cylinder and housing at several positions;

DESCRIPTION OF A PREFERRED EMBODIMENT

Figure 1:
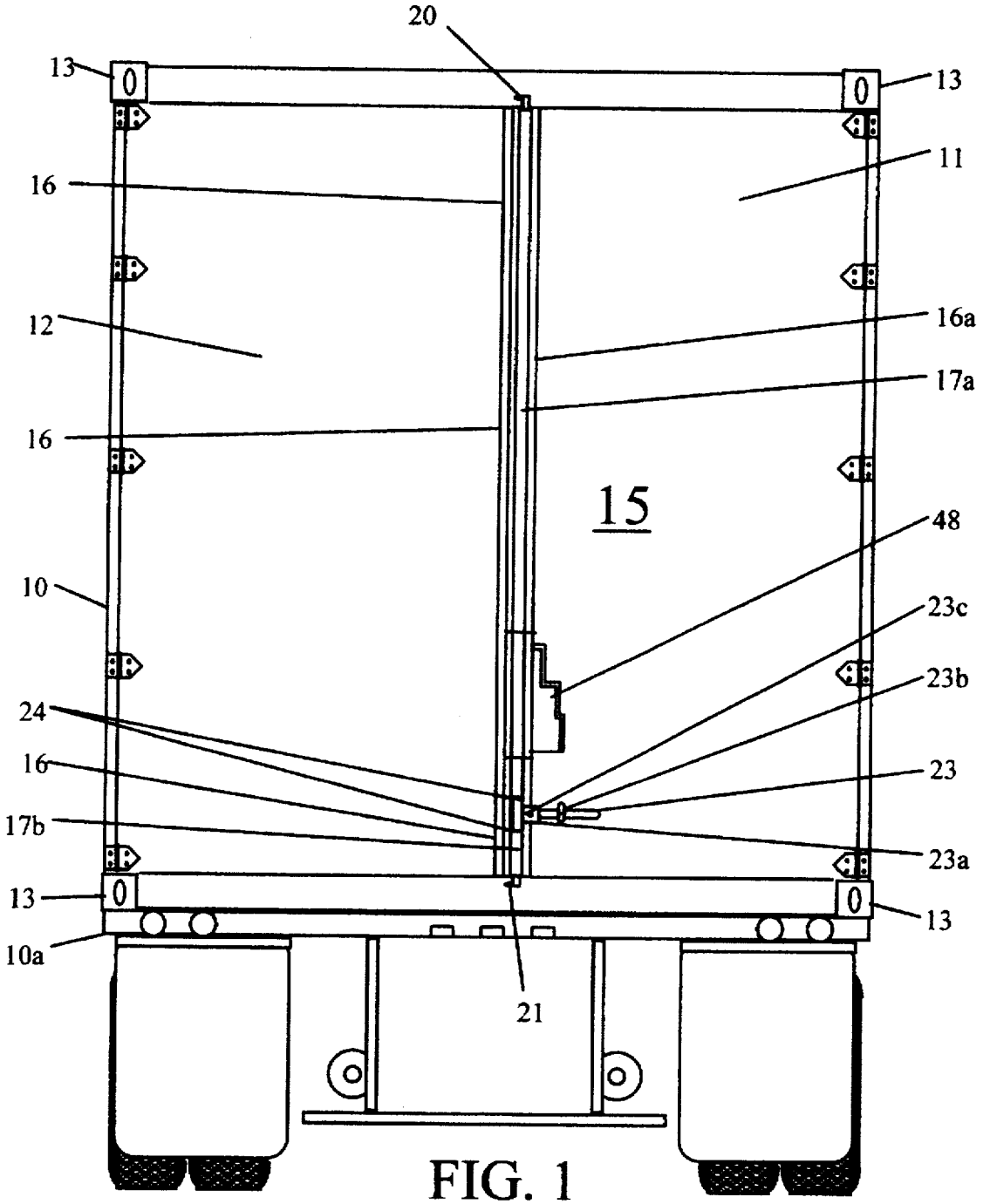
FIG. 1 illustrates an intermodal cargo container.

FIG. 1 illustrates a rear view of highway semi-trailer 10a conveying intermodal cargo container 10. Attached to one end of container 10 are hinged doors 11 and 12. Cam lock mechanism 15 is mounted on door 11 and spans the length of the door. Cam lock mechanism 15 is a low profile shielded cam lock rod with a shielded locking device secured by a padlock.

Figure 2:
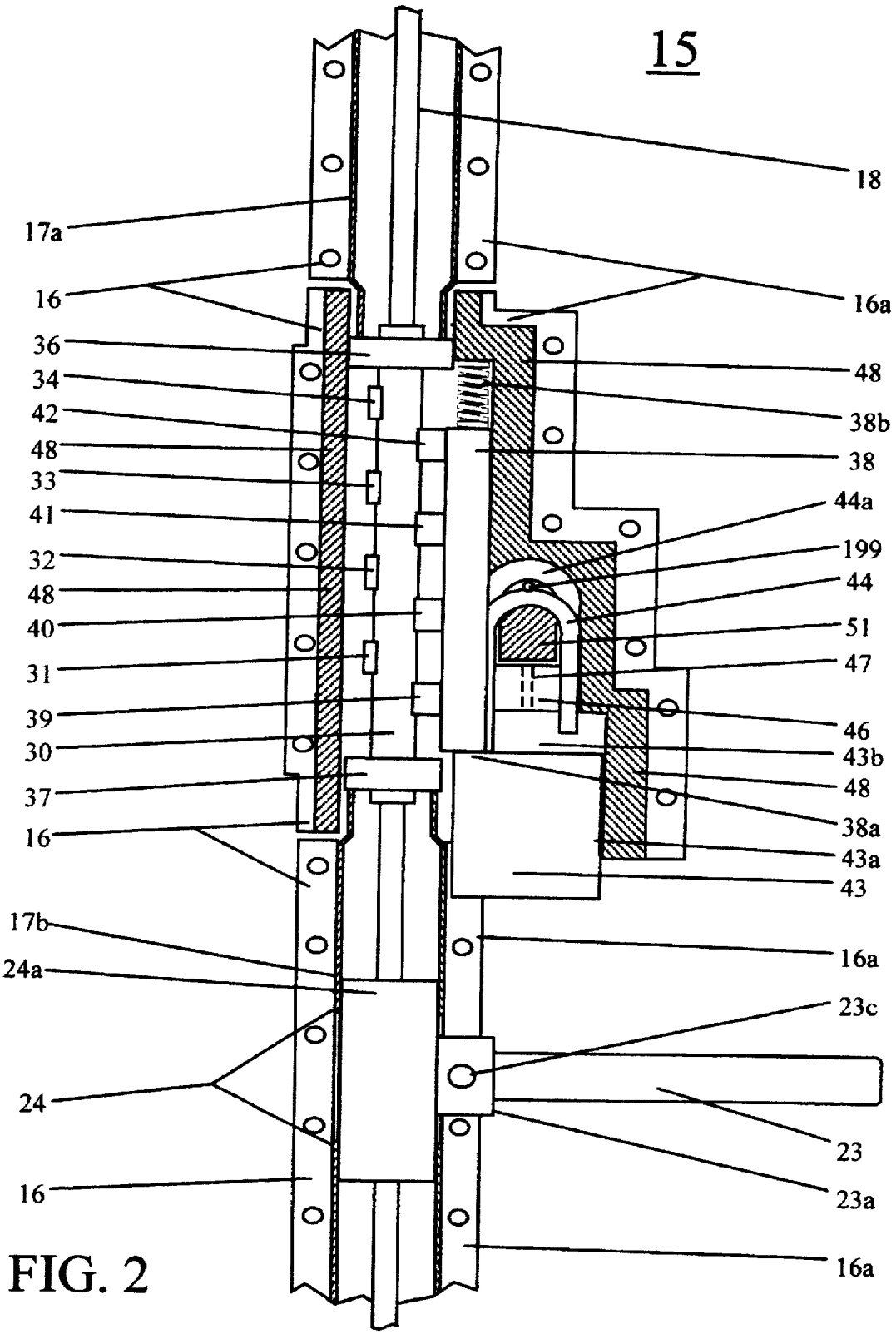
FIGS. 2 and 2a illustrate a cam locking mechanism according to the present invention.

Cam lock mechanism 15 shown in FIG. 1 is built around cam lock rod 18 (see FIG. 2). Cam lock rod 18 is encased in flanged housings 17a, 17b and one side of flanged housing 48. The other side of flanged housing 48 contains self-locking padlock 43 as shown in FIG. 2. Cam lock 20 is attached to one end of cam locking rod 18 and cam lock 21 is attached to the other end of cam lock rod 18. Tamper resistant fasteners, similar to those illustrated in FIG. 4b, are inserted through holes in mounting flanges 16 and 16a to securely attach cam locking mechanism 15 to door 11.

Typically, when a pair of hinged doors is secured by cam lock rods, the edge of one door will over lap the edge of the adjacent door. That is the case in FIG. 1 where the edge of door 11 overlaps the edge of door 12. Thus, securing door 11 secures door 12. In an alternate embodiment (FIG. 4b), "U" shaped mounting flange 16c is positioned over and secured to the edge of door 11. An extension 16d of the mounting flange 16 overlaps the edge of door 12. Flange 16c would function as a backing plate to make it more difficult for the tamper resistant fasteners to be forcefully pulled through door 11, and it would also make the edge of door 11 more rigid.

Doors 11 and 12 are either opened or sealed by rotating handle 23. In the unlocked condition of locking mechanism 15, cam lock rod 18 is free to rotate. Therefore, rotation of handle 23 in a clockwise direction, starting from the position illustrated in FIG. 1, rotates cam lock rod 18, which turns cam locks 20 and 21 releasing them from their respective detents (not shown). This results in door 11, and door 12 which is overlapped by the edge of door 11, becoming unlatched and unsealed. Conversely, after insertion of lock rod cams 20 and 21 into their respective detents (not shown), rotation of handle 23, from the position shown in FIG. 2a, in a counter clockwise direction (ending the rotation with the handle positioned as shown in FIG. 1), results in door 11 and door 12, which is overlapped by the edge of door 11, being latched and sealed.

Locking mechanism 15 is operated in essentially the same manner as a conventional cam lock rod. Several of the components of cam lock mechanism 15, including cam locks 20 and 21, handle 23, hinge support 23a and hasp 23b, are similar in form and function to those found on a conventional cam lock rod. However, unlike a conventional cam lock rod device, the locking mechanism and the cam lock rod are shielded from tampering by flanged housings 48, 17a and 17b. In addition, two of the components, the fasteners which secure hasp 23b to door 11, and the shear pins (196 in FIG. 19) which secure sleeve 24a to cam lock rod 18 should break away; if excessive force is applied to either. The flanged housing, which encases the locking hardware and cam lock rod 18, as well as the break away features of hasp 23b and shear pins 196 connecting sleeve 24a to cam lock rod 18, greatly reduces the probability of successfully prying off handle 23 to defeat the locking mechanism, or pulling or prying, locking mechanism 15 from door 11. Alternately, sleeve 24a may be secured to lock rod 18 in the same manner that lock cylinder 30 is secured to lock rod 18. Sleeve 24a could have a hexagonal opening broached from end to end that would engage a corresponding hexagonal section of lock rod 18. In this case, handle 23 would be fabricated in such a manner that it would break or bend upon application of excessive force. An additional benefit is derived from encasing lock rod 18 inside of a protective housing secured to door 11. The housing can add rigidity to the door edge, which would produce a better weather seal as well as make the door edge stronger and more resistant to prying.

Figure 2A:
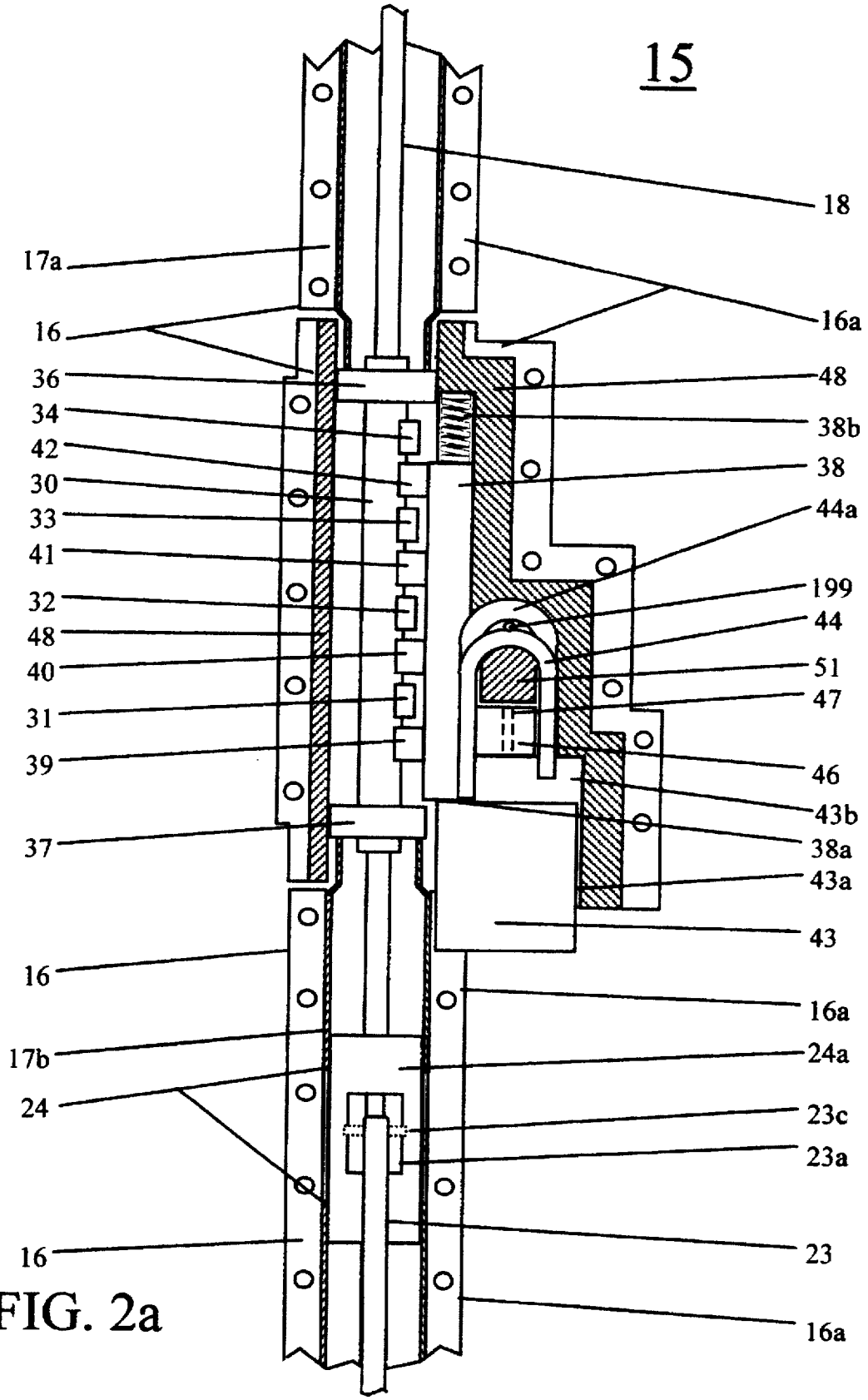

FIGS. 2 and 2a illustrate cam lock mechanism 15 in more detail, and as it would appear in the unlocked condition; if a longitudinal section had been cut away from flanged housings 17a, 48 and 17b. In FIG. 2a, handle 23, cam lock rod 18, and locking cylinder 30 have been rotated clockwise 90 degrees from the position shown in FIG. 2.

One end of both flanged housing 17*a* and 17*b* is reduced in diameter to allow insertion into the corresponding ends of flanged housing 48. The three flanged housings 17*a*, 17*b* and 48 are securely attached to door 11 with tamper resistant fasteners, inserted through holes in mounting flanges 16 and 16*a*. Flanged housings 17*a*, 48 and 17*b* encase and protect cam locking rod 18. Cam lock rod 18 extends longitudinally through both locking cylinder 30, which is contained in one side of flanged housing 48, and through sleeve 24*a*, which is contained in flanged housing 17*b*. Sleeve 24*a* is secured to cam lock rod 18 by shear pins 196 (see FIG. 9). Hinge support 23*a*, (FIG. 2*a*), which is an integral part of sleeve 24*a*, extends through opening 24 in flanged housing 17*b*. Opening 24 is sized to allow limited longitudinal, and more than 90 degrees of rotational movement of sleeve 24*a* with hinge support 23*a*, without exposing cam lock rod 18 to tampering. Handle 23 is connected to hinge support 23*a* by means of hinge pin 23*c*.

A hexagonal section of cam lock rod 18 extends through and engages a corresponding hexagonal hole, broached from end to end, through locking cylinder 30. This allows limited longitudinal movement of cam lock rod 18, relative to locking cylinder 30. Locking cylinder 30 does not move longitudinally relative to housing 48. Locking cylinder 30 securely engages cam lock rod 18 for rotational movement (Multiple splines similar to those illustrated in FIG. 15 would work equally well). Locking cylinder 30 is centrally mounted relative to its corresponding opening in flanged housing 48 by bushings 36 and 37. Projections 31, 32, 33,and 34 extend partially around locking cylinder 30. Projections 31, 32, 33 and 34 are identical to each other in size and shape; and the space between each projection is equal. Projections 39, 40, 41 and 42 on sliding latch 38 are identical to each other in size, shape and spacing. The width of projections 31, 32, 33 and 34 on locking cylinder 30, and the spacing between them matches the width and spacing of projections 39, 40, 41 and 42 on sliding latch 38. The dimensions for the width and spacing are determined by the distance traveled by padlock body 43*a* between the locked and unlocked condition, when shackle 44 is held stationary in housing 48. The spaces between the projections on both locking cylinder 30 and sliding latch 38 are slightly wider than the projections themselves, which enables the projections of lock cylinder 30 to intermesh with the projections of component 38. Corresponding projections 39, 40, 41, and 42 on sliding latch 38 alternately interact, and then intermesh with projections 31, 32, 33, and 34 on lock cylinder 30, in the locked, and then the unlocked conditions, respectively, of locking mechanism 15. There can be more or fewer projections on sliding latch 38 and locking cylinder 30. Projections 39, 40, 41, and 42 on sliding latch 38 have a concave surface which is at all times in close sliding contact with the corresponding convex surface of locking cylinder 30.

Self locking padlock 43 is installed in one side of flanged housing 48, where it is retained in both the locked and unlocked condition and is removed only for servicing. When padlock 43 is installed in flanged housing 48, the only part of padlock 43 that is accessible is the key end. The side of flanged housing 48 which receives padlock 43, has an interior void which functions as a socket with two sections. The upper section of the socket, designated 44*a* (see FIG. 4*a*), receives padlock shackle 44, removable grooved shackle retainer 51 (see FIG. 2) and filler block 46 with guide key 47 (see FIG. 4). One side of the upper section of the socket is formed by sliding latch 38. Sliding latch 38, which has concave groove 38*a* (also see FIG. 7), engages one side of one leg of padlock shackle 44. The upper section of flanged housing 48 also receives removable, grooved, padlock shackle retainer 51 (see FIGS. 2 and 5). The lower section of the socket, designated 43*b* (see FIGS. 2, 2*a* and 4*a*), receives padlock body 43*a* and is sized to allow unrestricted movement of padlock body 43*a* as it is inserted into and partially ejected from its corresponding opening in flanged housing 48.

Initial installation of padlock 43 into flanged housing 48 begins with padlock 43 in the unlocked condition, with shackle 44 fully extended. Filler block 46, which has guide key 47, is snapped into position between the rods of padlock shackle 44. The shackle end of padlock 43 is then inserted into the open end of flanged housing 48 until the curved end of the shackle reaches the end of 44*a*. Guide key 47 on filler block 46 engages key-way 44*b* (see FIG. 4*a*), in flanged housing 48, and prevents side to side movement of padlock shackle 44. Shackle retainer 51 is then inserted into its corresponding opening in housing 48. Padlock 43 is allowed to slide back toward the opening through which it was inserted in flanged housing 48 until the curved end of padlock shackle 44 is fully seated in the corresponding groove 51*a* (see FIG. 5) in shackle retainer 51. FIGS. 2 and 2*a* illustrate shackle retainer 51 with the top portion removed to reveal the curved portion of padlock shackle 44. Retainer pin 199 is then inserted to retain the padlock shackle in groove 51*a* of shackle retainer 51.

When self locking padlock 43 is unlocked, padlock body 43*a* is partially ejected from flanged housing 48, while padlock shackle 44 is retained and remains stationary in flanged housing 48. Sliding latch 38 engages padlock body 43*a* at 38*a*, at all times, and tension produced by compression spring 38*b* holds the two components together, and causes them to move as one unit. As a result, (see FIG. 2*a*) projections 31,32, 33 and 34 which are an integral part of locking cylinder 30 may move between and intermesh with projections 39, 40, 41 and 42, which are an integral part of sliding latch 38. In this unlocked condition of cam lock mechanism 15, handle 23 can be used to rotate cam lock rod 18 and locking cylinder 30, which is mounted on cam lock rod 18, disengaging cam locks 20 and 21 (FIG. 1).

Figure 3:
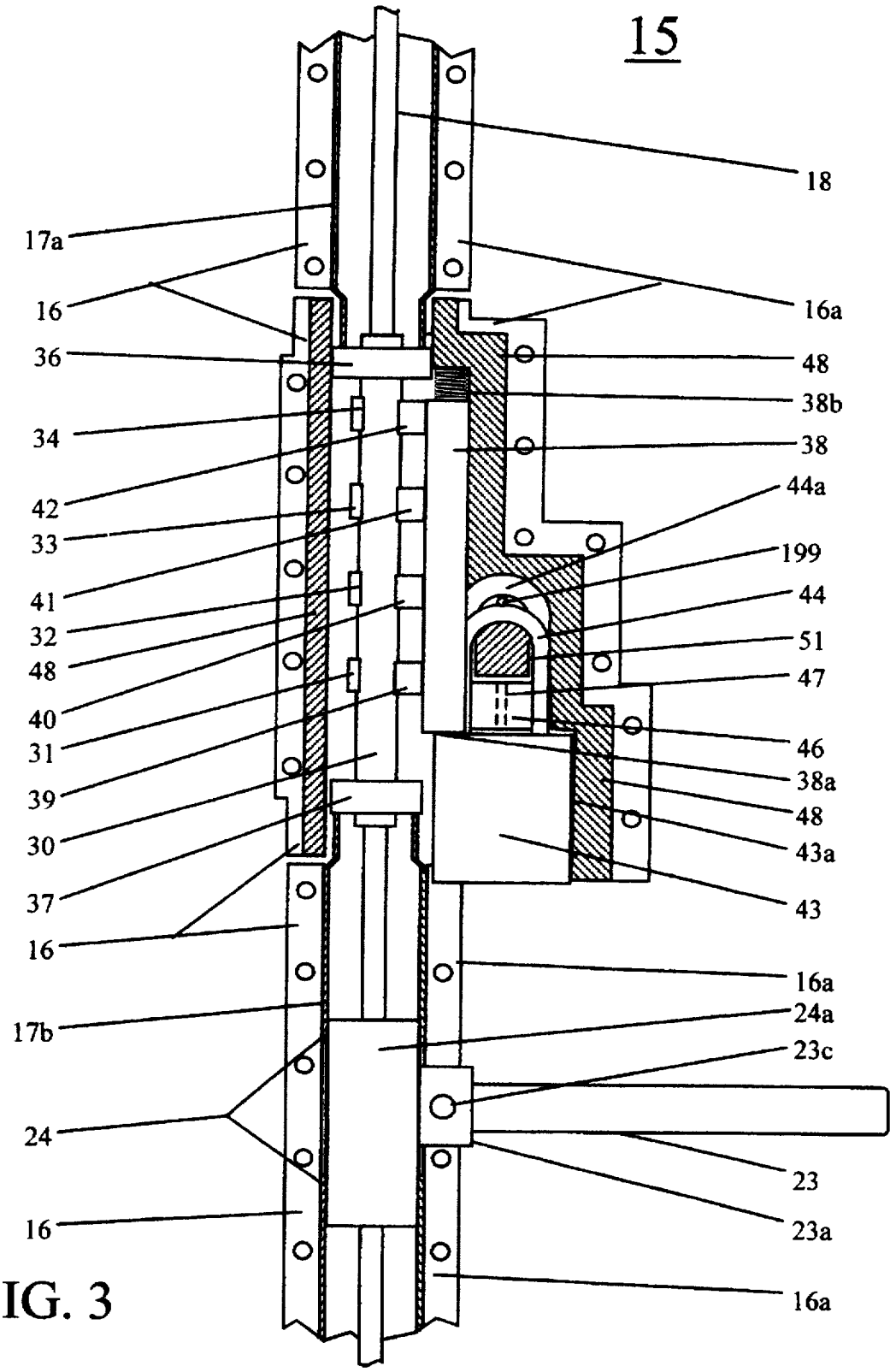
FIG. 3 displays cam locking mechanism details as they would appear in a locked condition.

FIG. 3 displays cam lock mechanism 15 in detail, as it would appear in the locked condition if a longitudinal section had been cut away. As in the unlocked condition of cam lock mechanism 15 (see FIGS. 2 and 2*a*), padlock shackle 44, filler block 46 with guide key 47, and shackle retainer 51 remain stationary. Locking cylinder 30 is maintained in a central position relative to its corresponding opening in flanged housing 48, by bushings 36 and 37, which function as bearings, to allow rotational movement of locking cylinder 30, but not longitudinal movement.

To shift cam lock mechanism 15 to the locked condition shown in FIG. 3, handle 23 must be rotated counter clockwise from the position shown in FIG. 2*a*, until it is parallel with the surface of door 11, as shown in FIG. 2. In this condition, locking cylinder 30, with projections 31, 32, 33, and 34, is positioned so that sliding latch 38, with projections 39, 40, 41, and 42, may be moved longitudinally to a position that would block rotational movement of locking cylinder 30. This is accomplished by applying sufficient force to the key end of self locking padlock 43 to push partially ejected padlock body 43*a* back into opening 43*b* in flanged housing 48, until padlock 43 is snapped into the locked condition. Padlock body 43*a* and sliding latch 38, moving as one unit, compress spring 38*b*, as sliding latch 38 is moved into the locked condition at the end of its travel. As a result, projections 39, 40, 41 and 42 on sliding latch 38 block the rotational path of projections 31, 32, 33 and 34 on locking cylinder 30. In this condition cam lock rod 18, which is engaged by locking cylinder 30, is blocked from rotating. Therefore handle 23 cannot be used to rotate sleeve 24*a* which engages cam lock rod 18. As a result, cam lock rod 18 is blocked from rotation and cam locks 20 and 21 (FIG. 1) cannot be disengaged from their respective detents to release and unseal doors 11 and 12.

Figure 4:
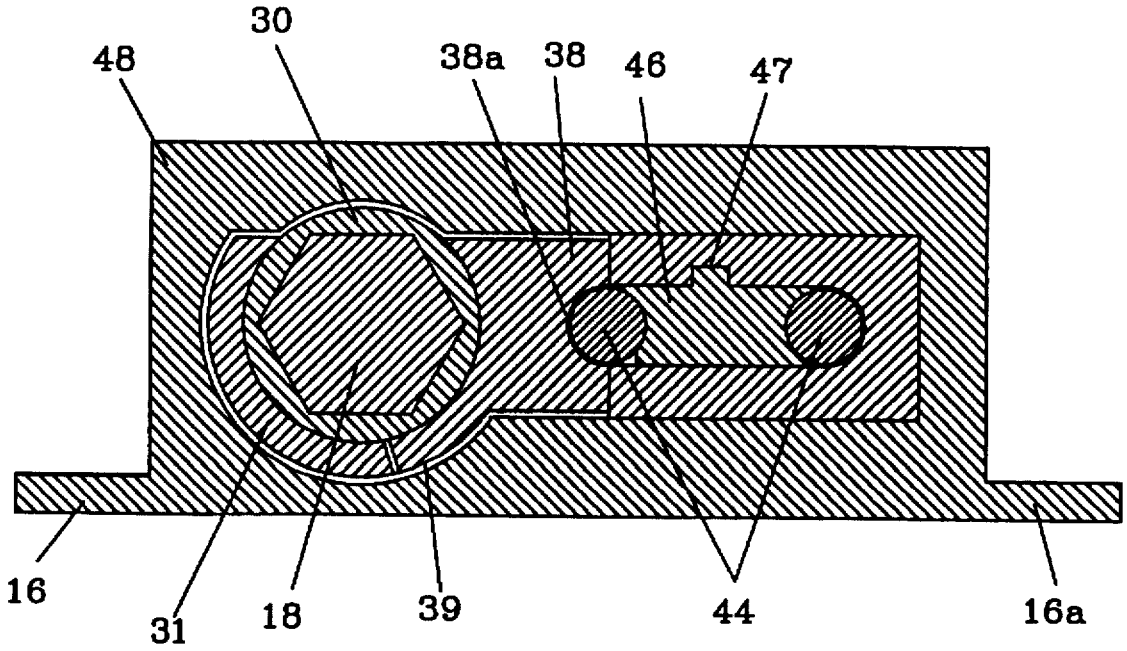
FIG. 4 displays a cross-sectional view of flanged lock housing.
Figure 4A:
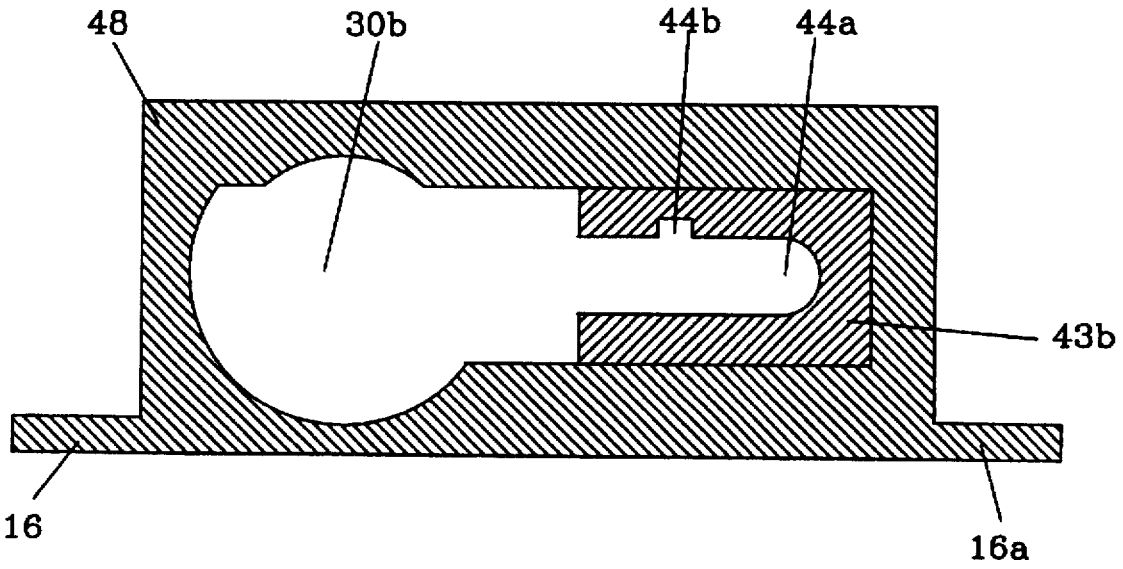
FIG. 4a illustrates the same cross-sectional view of the flanged housing 48 of FIG. 4 without the component parts.
Figure 4B:
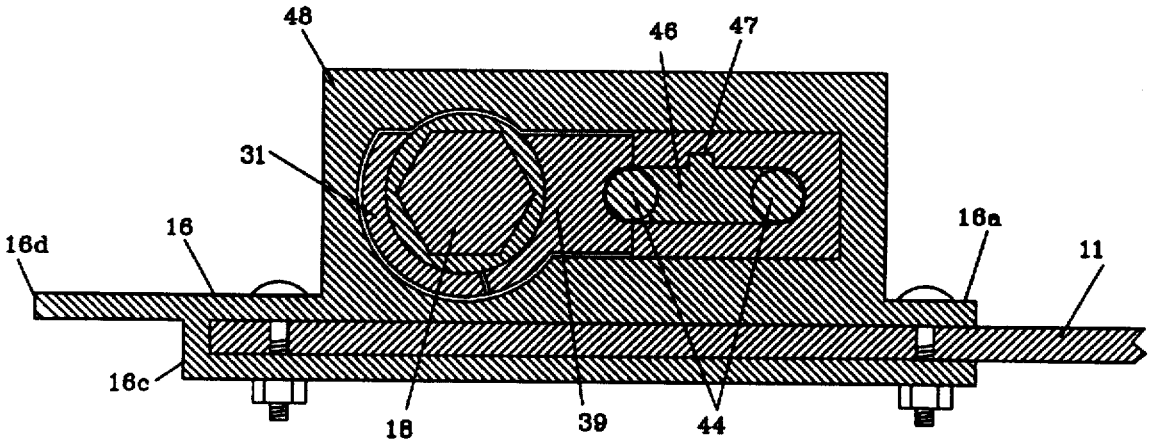
FIG. 4b illustrates, in cross-section, of a flanged lock housing attached to the door of a cargo container.

FIG. 4 displays a cross-sectional view of flanged housing 48 as it would appear; if a cut were to be made across both rods of padlock shackle 44, as well as projection 39 on sliding latch 38 and projection 31 on locking cylinder 30. FIG. 4*a* illustrates the same cross-sectional view of flanged housing 48 as displayed in FIG. 4, but without the component parts. Flanged housing 48 receives padlock 43 on one side and locking cylinder 30 on the other side. A hexagonal portion of cam lock rod 18 passes longitudinally through the center of locking cylinder 30. Sliding latch 38 is retained between, and in close sliding contact with, locking cylinder 30 and one side of one rod of padlock shackle 44.

The side of flanged housing 48 that receives padlock 43 is a socket of the approximate shape and size of padlock 43 in the unlocked condition with its shackle fully extended. The upper portion of the socket that receives padlock shackle 44 is deep enough to receive the shackle in its fully extended, unlocked condition; which allows enough space for padlock shackle 44 to be disengaged from groove 51*a* in padlock shackle retainer 51, illustrated in FIG. 5. One side of this socket is formed by sliding latch 38 which has a concave groove 38*a* (see FIGS. 7 and 24) which engages one side of one rod of padlock shackle 44. The center of this socket receives filler 46, with guide key 47, which is snapped into position between the rods of padlock shackle 44, before padlock 43 is inserted into flanged housing 48. Guide key 47, which engages key way 44b (FIG. 4*a*) in flanged housing 48, prevents lateral movement of padlock shackle 44. The section of the socket designated 43b, receives padlock body 43*a*, and is sized to allow unrestricted movement of padlock body 43*a* as it is inserted into and partially ejected from housing 48.

The portion of flanged housing 48 that receives locking cylinder 30 is a longitudinal opening designated 30*b*, shown in cross-section in FIG. 4*a*. Locking cylinder 30 is held in a central position relative to its corresponding opening in flanged housing 48 by bushings 36 and 37 (FIGS. 2, 2*a* and 3). Opening 30*a* (see FIG. 8) in locking cylinder 30 receives and engages the corresponding hexagonal portion of cam lock rod 18.

Figure 5:
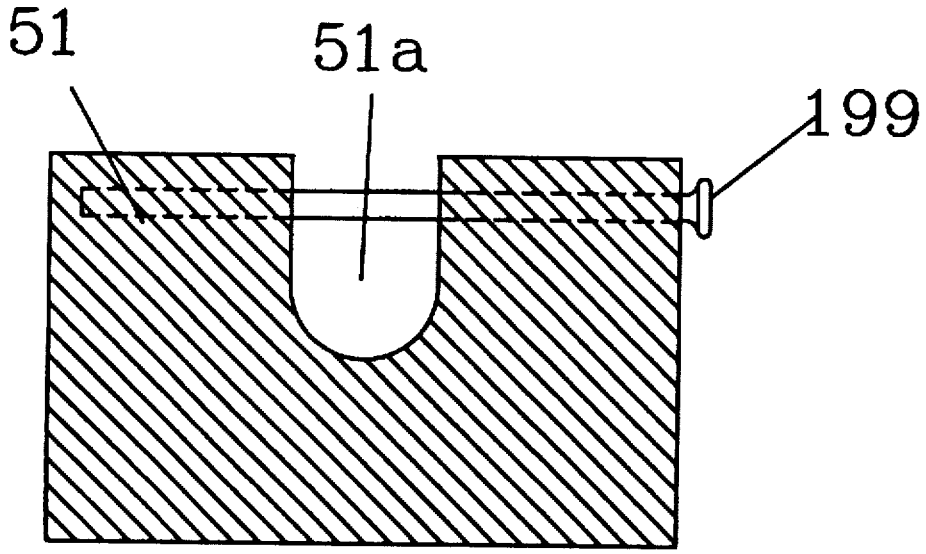
FIG. 5 is a side view of removable, grooved, padlock shackle retainer.

FIG. 5 is a side view of removable, grooved, padlock shackle retainer 51. The width of groove 51*a* in shackle retainer 51, is approximately equal to the diameter of the padlock shackle that it receives. The depth of groove 51*a* is greater than the diameter of the padlock shackle that it receives. When padlock shackle retainer 51 is installed in flanged housing 48, with padlock shackle 44, and held in groove 51*a* by pin 199, with padlock 43 in the locked condition, unauthorized removal of either padlock 43 or padlock shackle retainer 51 is virtually impossible without destroying the components of locking mechanism 15. However, if padlock 43 is in the unlocked condition, both padlock shackle retainer 51 and padlock 43 can easily be removed (without tools) from flanged housing 48 for any required servicing.

Figure 6:
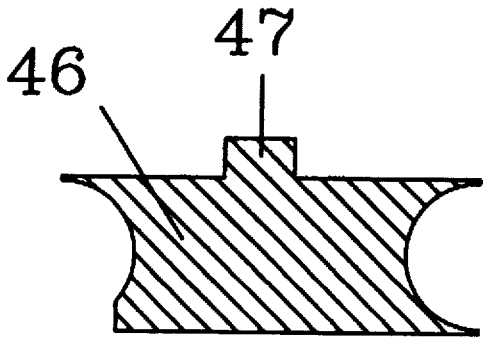
FIG. 6 shows a filler block used in the flanged lock housing.

Filler block 46 with guide key 47, shown in cross-section in FIG. 6, performs two functions. Filler block 46 is snapped into position between the rods of padlock shackle 44. Then, as padlock shackle 44 is inserted into flanged housing 48, guide key 47 engages key way 44*b* (FIG. 4*a*) and prevents lateral movement of shackle 44. Filler block 46 also fills a void between padlock body 43 and shackle retainer 51.

Figure 7:
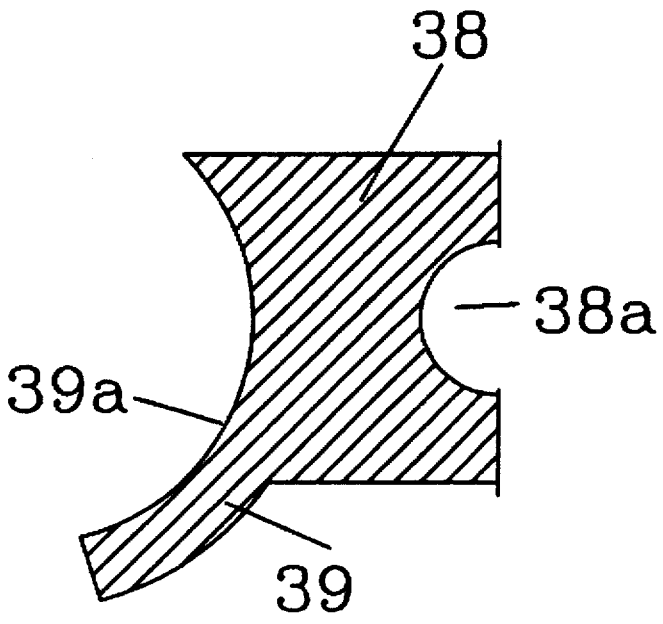
FIG. 7 is a cross-sectional view of a part used in the flanged lock housing.

FIG. 7 is a cross-sectional view of sliding latch 38 at projection 39. Projections 39, 40, 41 and 42 are identical to each other in size, shape and spacing on sliding latch 38. Projections 39, 40, 41 and 42, on sliding latch 38, have a concave surface 39*a* which remains in close sliding contact with the corresponding convex surface of locking cylinder 30. On the opposite side of sliding latch 38 is concave groove 38*a*, which engages and slides along one side of one rod of padlock shackle 44.

Figure 8:
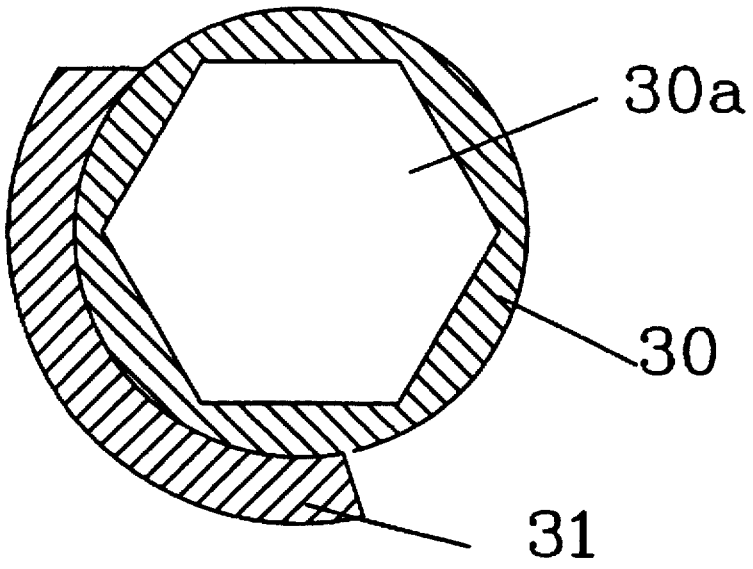
FIG. 8 is a cross-sectional view of the locking cylinder and one of the locking projections.

FIG. 8 illustrates a cross-sectional view of lock cylinder 30 at projection 31. Hexagonal opening 30*a* receives and engages the corresponding hexagonal section of cam locking rod 18.

Figure 9:
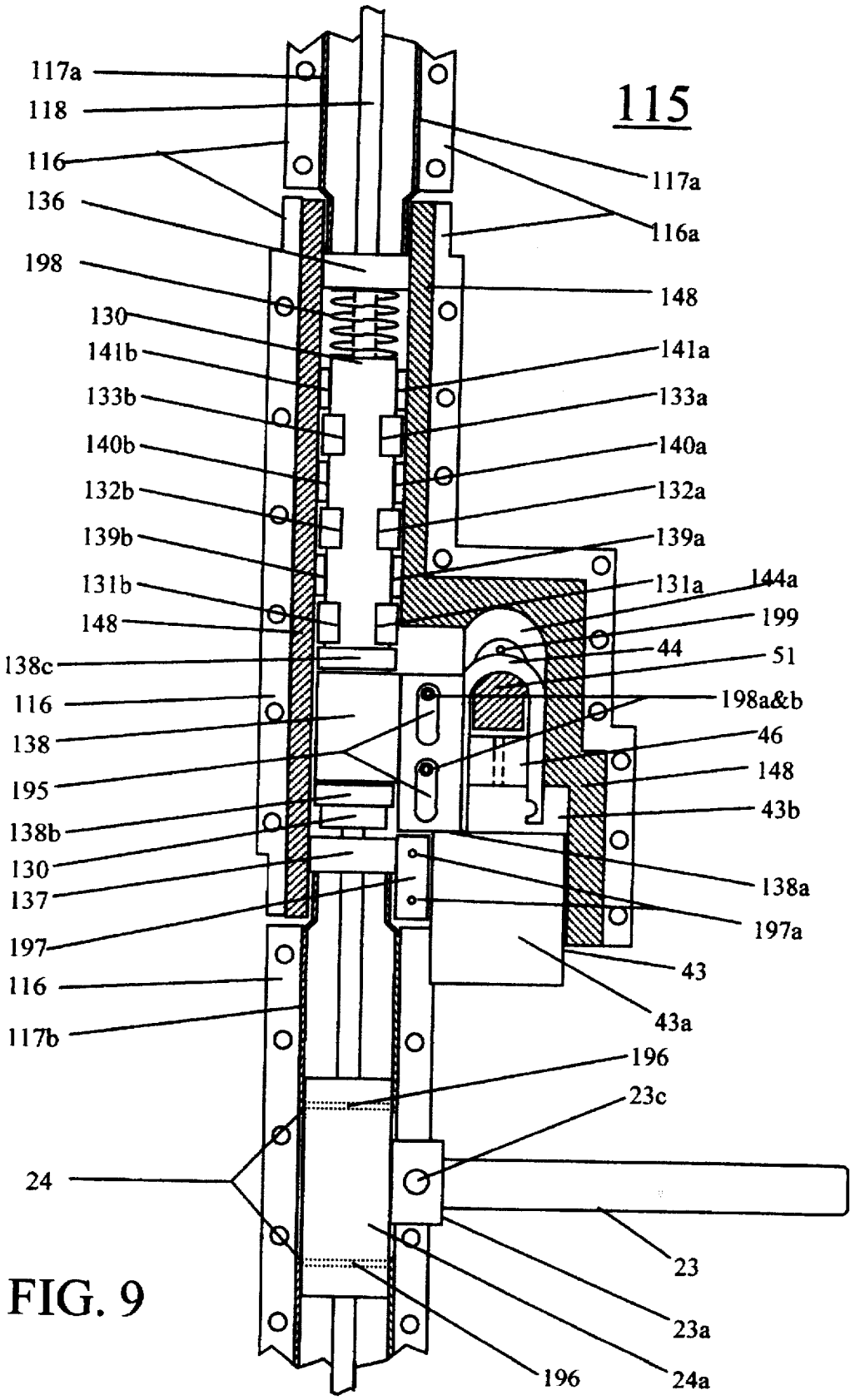
FIG. 9 illustrates a cut-away view of a second embodiment of a lock mechanism.

When self locking padlock 43 is unlocked with a key; padlock body 43*a* is partially ejected from flanged housing 48. Sliding latch 38 and padlock body 43*a* move as one unit, and they are pushed to the end of their travel by spring 38*b*. As a result, projections 39, 40, 41 and 42, on sliding latch 38, are removed from the rotational path of projections 31, 32, 33 and 34 on locking cylinder 30. This allows handle 23 to be used to rotate sleeve 24*a* (which engages rod 18), in a clock wise direction, releasing cam locks 20 and 21, and permitting doors 11 and 12 to be opened. Flanged housings 17*a*, 17*b* and 48 are secured to door 11 by tamper resistant fasteners, installed through holes in mounting flanges 16 and 16*a*. Since cam lock rod 18 is encased in flanged housings 17*a*, 17*b* and 48, which are secured to door 11, a chain or cable cannot be placed under cam lock rod 18 to forcibly pull it from door 11. Handle 23, is connected to hinge support 23*a*. Hinge support 23*a* is an integral part of sleeve 24*a*, which is secured to cam locking rod 18 by shear pins 196 (FIG. 9). The shear pins would fail in the event that excessive force were to be applied to handle 23 while locking mechanism 15 is in the locked condition. If pins 196 were sheared, cam lock rod 18 would remain in the locked condition, but sleeve 24*a* with handle 23 would be free to turn on cam locking rod 18. Hasp 23*b*, which provides an optional means to secure locking rod handle 23 with either a padlock or a security seal, is attached to door 11 with fasteners which would easily break away upon application of excessive force. Flanged housings 17*a*, 48 and 17*b*, encasing cam lock rod 18, and securely attached to the door 11, add rigidity to the door. When padlock shackle retainer 51 is installed in flanged housing 48, with padlock shackle 44 fully engaged in groove 51*a*, and with padlock 43 in the locked condition; unauthorized removal of either padlock 43 or padlock shackle retainer 51 is virtually impossible without destroying components of locking mechanism 15. However, if padlock 43 is in the unlocked condition, both padlock shackle retainer 51 and padlock 43 can be easily removed from flanged housing 48 for any required servicing without the use of tools. Locking mechanism 15 is designed to allow limited longitudinal movement of cam locking rod 18 in relation to locking cylinder 30 to prevent binding or jamming of the locking mechanism, as a cargo container door frame is subjected to twisting or racking forces during lifting or travel over uneven terrain. Locking mechanism 15 is operated in essentially the same manner as a conventional cam lock rod device, and an operator can choose to secure handle 23 to hasp 23*b* (FIG. 1) with only a seal or a padlock rather than locking padlock 43. Cam lock mechanism 15 has a low profile design which would allow it to be installed on the doors of many existing cargo containers and not extend beyond the corner castings on the lower sill and upper door frame of the cargo container.

SECOND EMBODIMENT OF THE INVENTION

FIG. 9 illustrates a cut-away view of a second embodiment, lock mechanism 115. Padlock 43 is unlocked and padlock body 43a is partially ejected from housing 148. Lock cylinder 130 is aligned to allow it to either be moved longitudinally to the locked position (see FIG. 10), or rotated clockwise to position lock rod 118 in the unlatched position. Retainers 138b and 138c are secured to lock cylinder 130 and insure that component 138 moves longitudinally with lock cylinder 130. Lock cylinder 130 can rotate relative to component 138. Slots 195 allow component 138 to move longitudinally with lock cylinder 130, relative to components 198a and 198b, which are bolts with sleeves. Tension produced by spring 198 pushing against stationary bushing 136 and sliding lock cylinder 130 causes component 138, which is attached to component 130, to be held in constant contact with padlock body 43a at point 138a. As a result, any longitudinal movement of padlock body 43a, moves component 138, which results in an equal amount of longitudinal movement of lock cylinder 130. In this unlocked condition, the projections 131a, 131b and 131c, 132a, 132b and 132c and 133a, 133b and 133c on lock cylinder 130 are free to intermesh between the fixed projections 139a, 139b and 139c, 140a, 140b and 140c and 141a, 141b and 141c attached inside housing 148 (see FIGS. 15, 16 and 17). Therefore, when lock cylinder 130 is free to rotate, lock rod 118, which is engaged by lock cylinder 130, can be rotated to disengage cam locks at each end of lock rod 118. Tamper resistant fasteners may be inserted through holes in flanges 116 and 116a to secure locking mechanism 115 to a door or the like.

Figure 10:
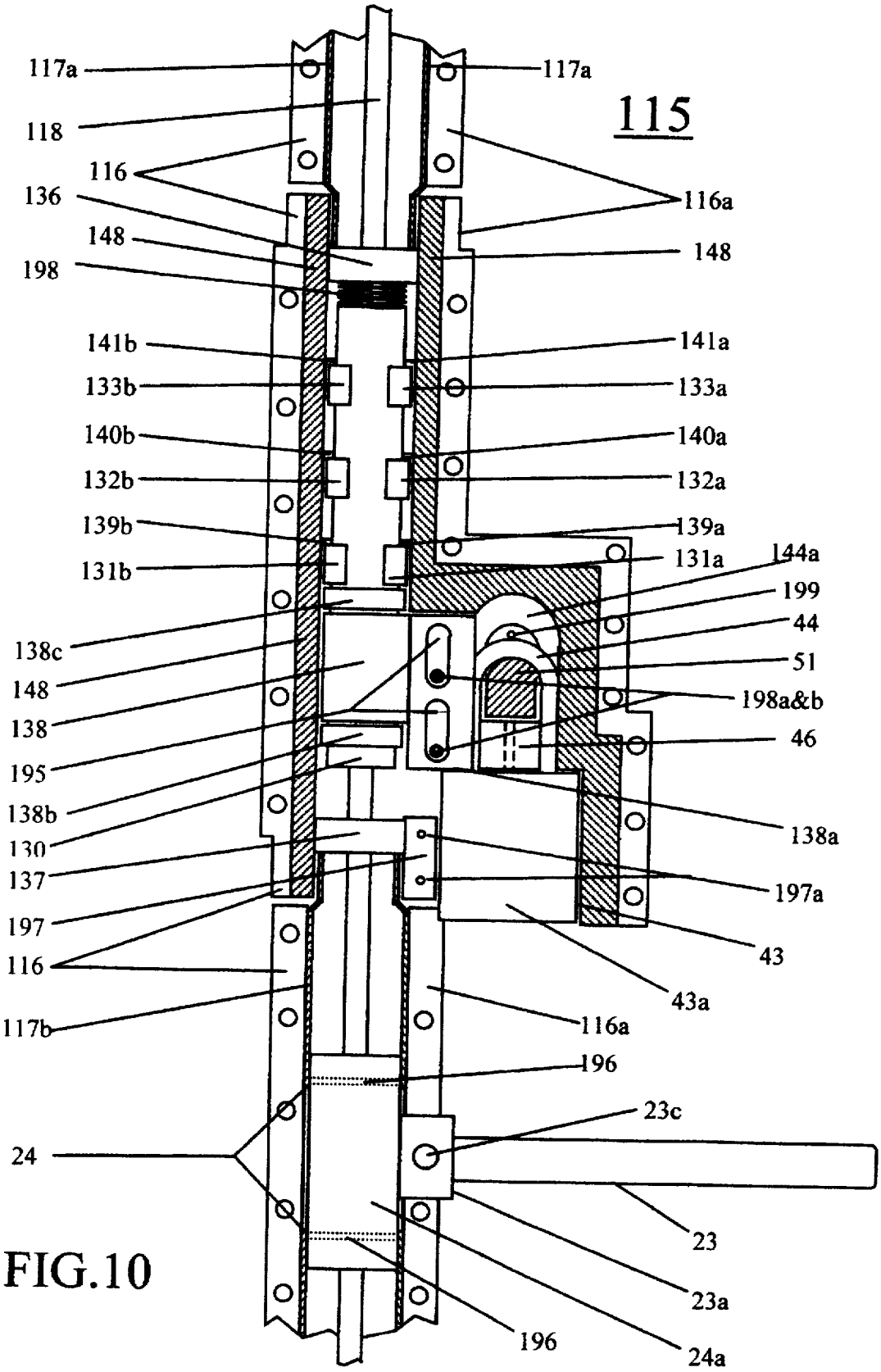
FIG. 10 illustrates a cut-away view of the lock mechanism in a locked condition.

FIG. 10 illustrates a cut-away view of lock mechanism 115 in the locked condition. Padlock body 43a has been pushed into its housing and the padlock is in the locked condition. As a result, lock cylinder 130 is positioned so that projections 131a, 131b and 131c, 132a, 132b and 132c and 133a, 133b and 133c on sliding lock cylinder 130 engage the corresponding fixed projections 139a, 139b and 139c, 140a, 140b and 140c and 141a, 141b and 141c which are attached inside of housing 148. Return spring 198 is compressed between bushing 136, which is secured to housing 148, and one end of lock cylinder 130. In the transition from the unlocked condition of FIG. 9 to the locked condition of FIG. 10, lock cylinder 130 slides freely in a longitudinal direction relative to lock rod 118. Since component 138 moves longitudinally with lock cylinder 130; tension produced by spring 198 pushing against lock cylinder 130, causes component 138 to be held in constant contact with the padlock body at point 138a. As a result, longitudinal movement of padlock body 43a results in longitudinal movement of lock cylinder 130 relative to lock rod 118 and housing 148. Thus, when components of locking mechanism 115 are positioned as shown in FIG. 9; the act of locking the padlock, by pushing padlock body 43a into its housing, results in lock cylinder 130 being positioned so that projections 131a, 131b and 131c, 132a, 132b and 132c and 133a, 133b and 133c are aligned with, and engage, fixed projections 139a, 139b and 139c, 140a, 140b and 140c and 141a, 141b and 141c. This blocks rotation of lock cylinder 130, which engages lock rod 118 and prevents lock rod 118 from turning. As a result, the cams at each end of lock rod 118 remain in the latched position.

Figure 11:
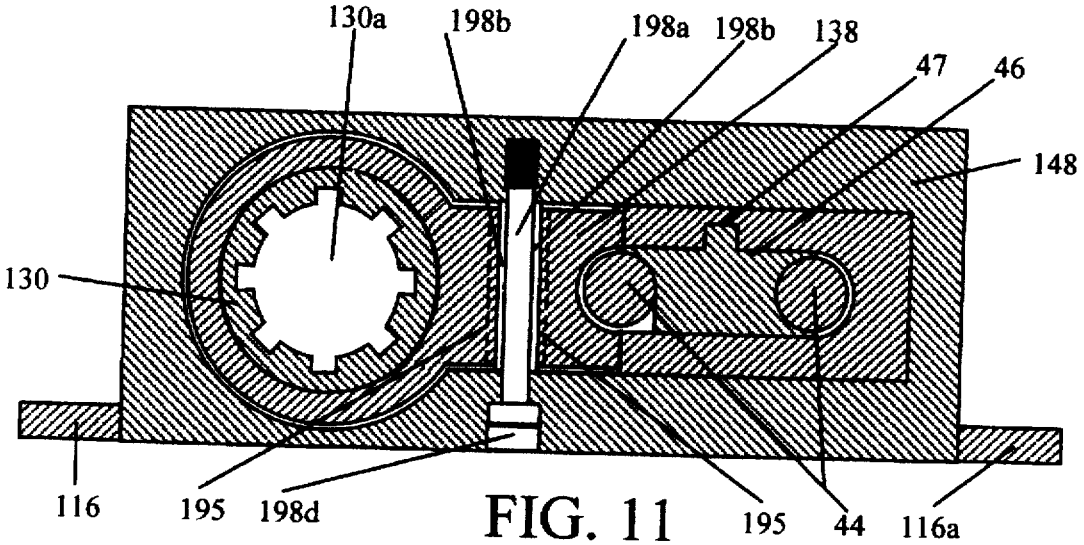
FIG. 11 illustrates a cross-sectional view of the lock housing at the point a locking component engages the lock cylinder.

FIG. 11 illustrates a cross-sectional view of housing 148 of lock mechanism 115. Component 138 engages lock cylinder 130 which is free to rotate in relation to component 138. Lock cylinder 130 has splined opening 130a which engages a corresponding splined section of lock rod 118. Bolt 198a is inserted through recessed hole 198d and sleeve 198b, and threaded into housing 148. Sleeve 198b provides resistance to crushing. Slot 195 is designated by dotted lines which are aligned parallel with bolt 198a.

Figure 12:
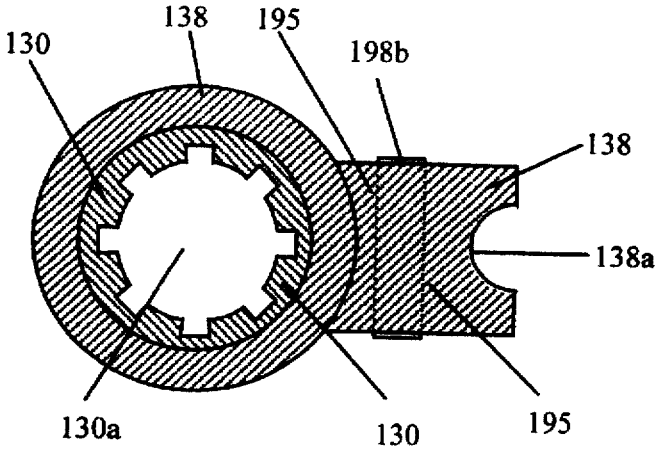
FIG. 12 illustrates a cross-sectional view of several of the locking components.

FIG. 12 illustrates a cross-sectional view of component 130 with sleeve 198b. Sleeve 198b extends from both ends of slot 195 in component 138. Groove 138a slides along one leg of padlock shackle 44.

Figure 13:
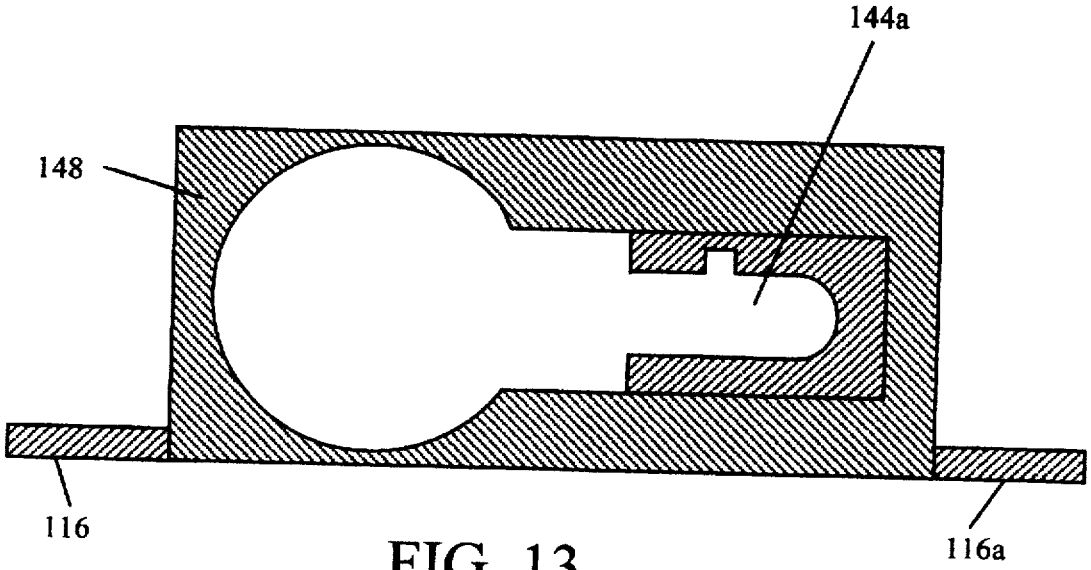
FIG. 13 illustrates a cross-sectional view of the housing of FIG. 11 with several components removed.

FIG. 13 illustrates a cross-sectional view of housing 148 near the position shown in FIG. 11, however, all of the component parts are removed from the housing. Opening 144a receives padlock shackle 44 and filler 46.

Figure 14:
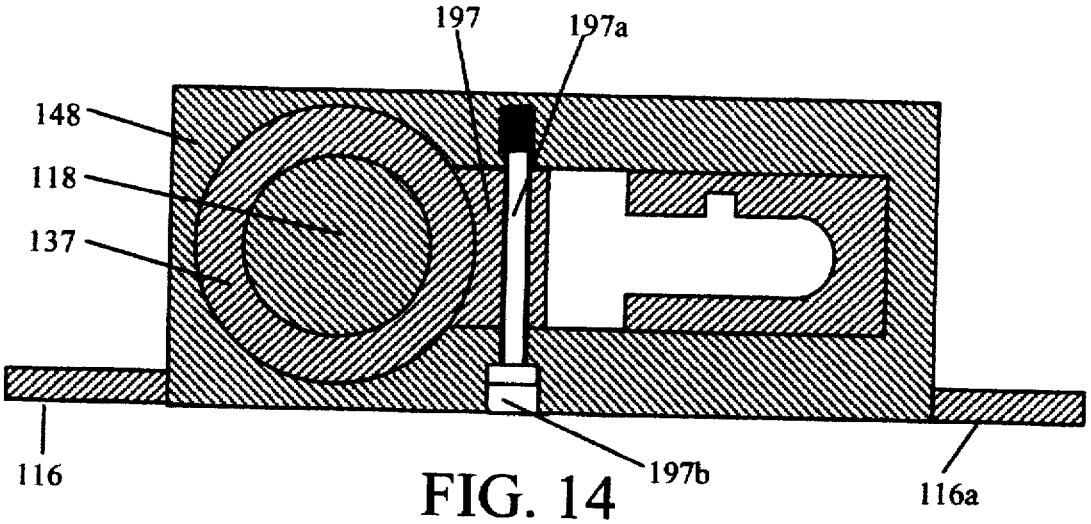
FIG. 14 illustrates a different cross-sectional view of the lock mechanism.

FIG. 14 illustrates a cross-sectional view of lock mechanism 115 across bushing 137 and filler 197. Component 197, a filler block, is shaped to fit in close contact with bushing 137 on one side and padlock body 43a on the other side (see FIGS. 9 and 10). Filler block 197, and bolts 197a provide additional strength to housing 148 to make it more resistant to prying and crushing. This portion of cam lock rod 118 is round in cross-section to allow rotation in bushing 137.

Figure 15:
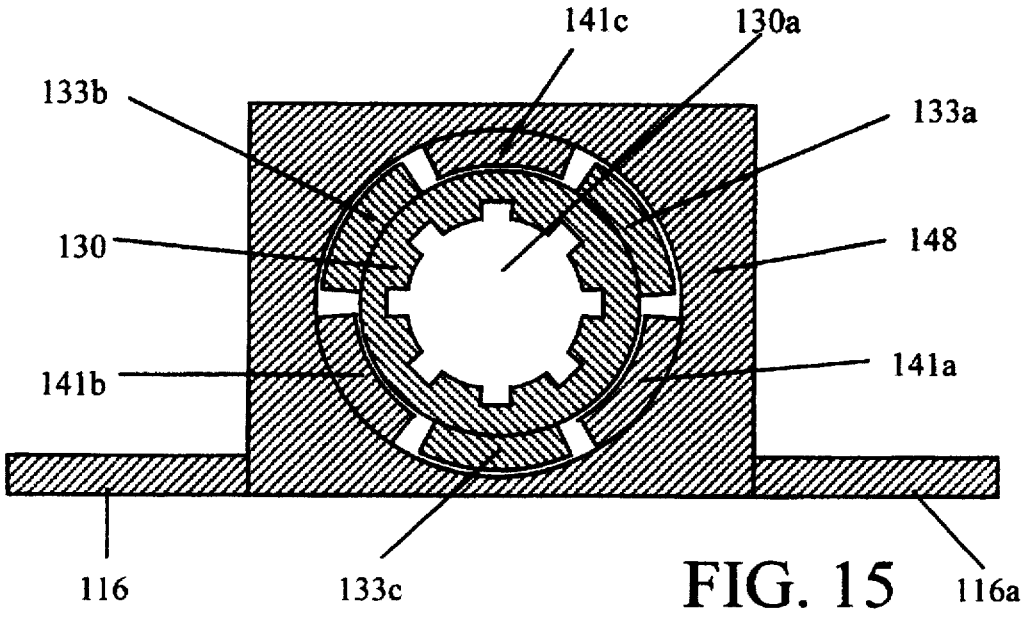
FIGS. 15, 16 and 17 show the locking cylinder housing and locking cylinder removed from the housing.

FIG. 15 illustrates a cross-sectional view of housing 148 at projections 133a, 133b and 133c on sliding lock cylinder 130; and projections 141a, 141b and 141c which are fixed inside of housing 148.

Figure 16:
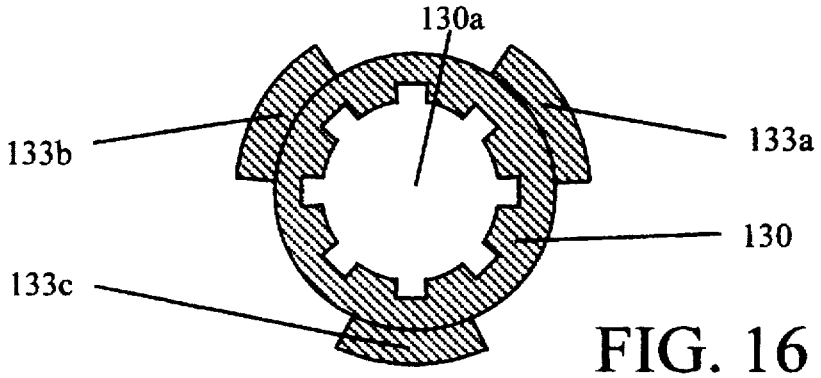

FIG. 16 illustrates a cross-sectional view of component 130 at projections 133a, 133b and 133c. Opening 130a is a splined opening which receives a corresponding splined section of lock rod 118.

Figure 17:
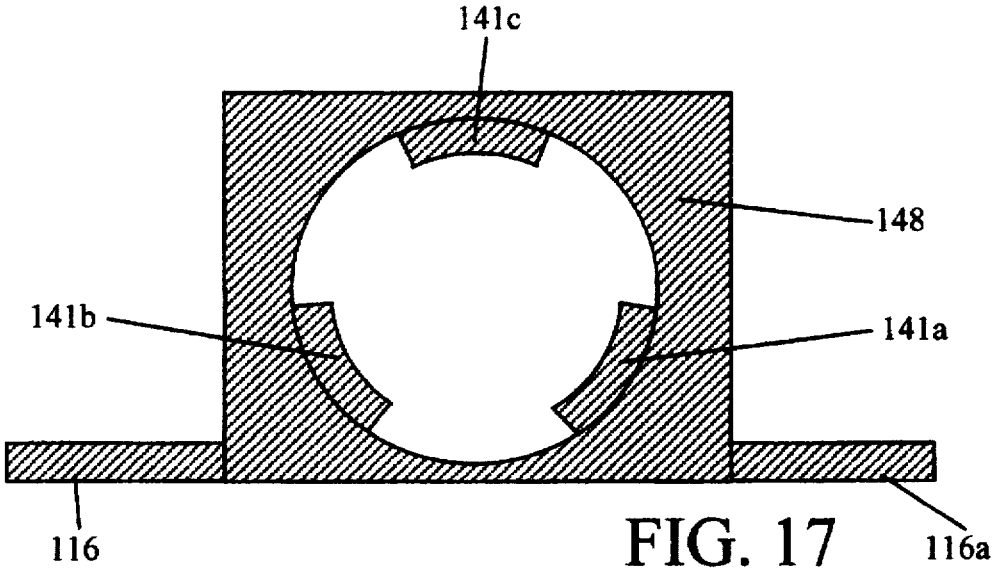

FIG. 17 illustrates a cross-sectional view of housing 148 at projections 141a, 141b and 141c as it would appear with components 130 and 118 removed.

THIRD EMBODIMENT OF THE INVENTION

Figure 17A:
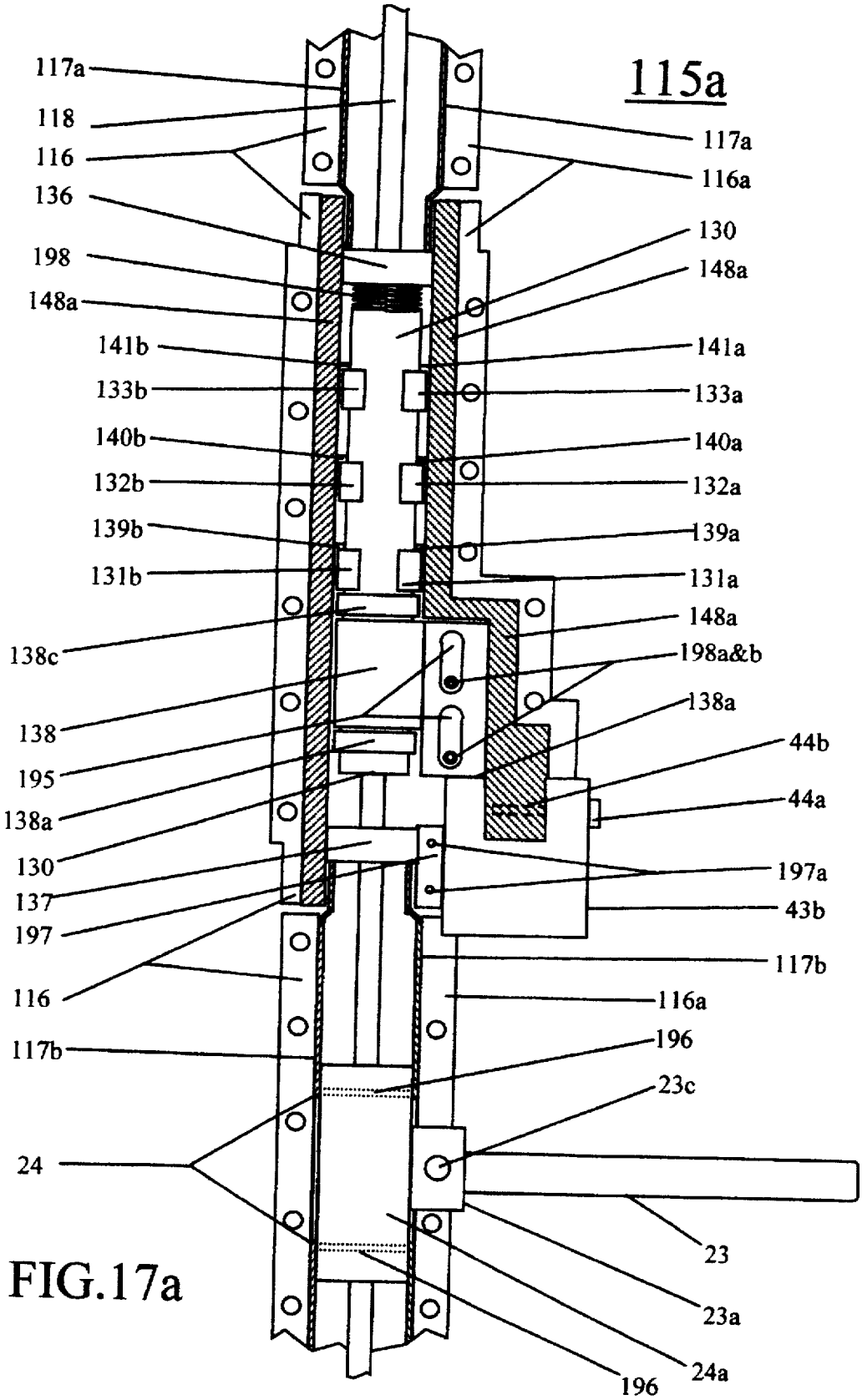
FIG. 17a illustrates a cut-away view of a third embodiment of a lock mechanism in a locked condition.

FIG. 17a illustrates an additional embodiment, lock mechanism 115a in the locked condition. All of the components and their functions are identical to lock mechanism 115 with the exception of straight shackled padlock 43b and a portion of housing 148a, which has been modified to receive a straight shackled padlock, rather than a curved shackle padlock. When padlock 43b is pushed into position to allow insertion of padlock shackle 44a into opening 44b, it pushes component 138 to the locked position. The result is exactly the same as when padlock 43 of lock mechanism 115 is pushed into the locked position.

Figure 17B:
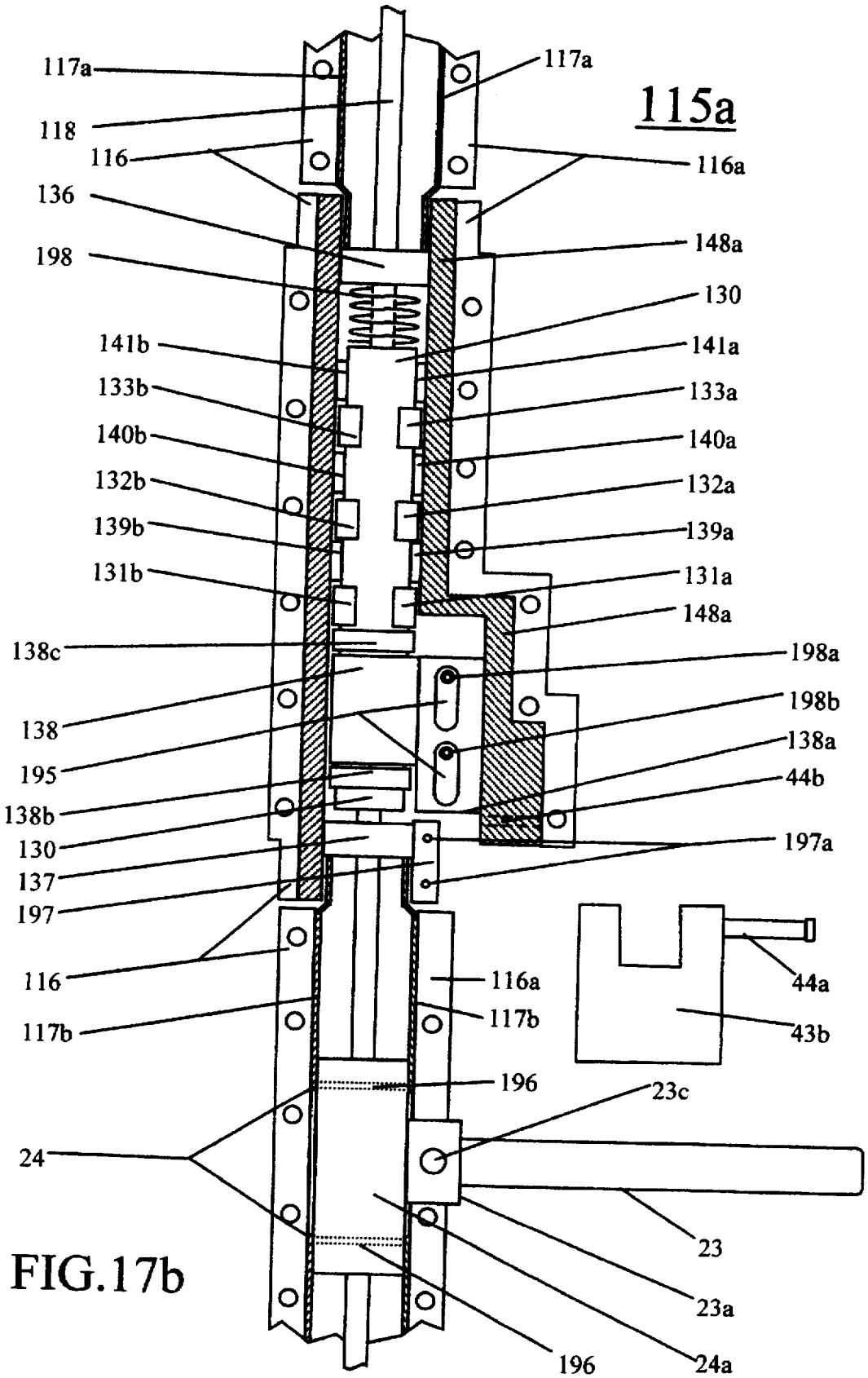
FIG. 17b illustrates a cut-away view of the lock mechanism in the unlocked condition.

FIG. 17b illustrates lock mechanism 115a in the unlocked condition. In contrast to lock mechanism 115, padlock 43b does not remain in a protective housing in the unlocked condition. When padlock shackle 44a is disengaged from opening 44b, and padlock 43b is removed as illustrated in FIG. 17B, the result is the same as when padlock 43 is unlocked and partially ejected from locking mechanism 115 as in FIG. 9.

FOURTH EMBODIMENT OF THE INVENTION

Figure 18:
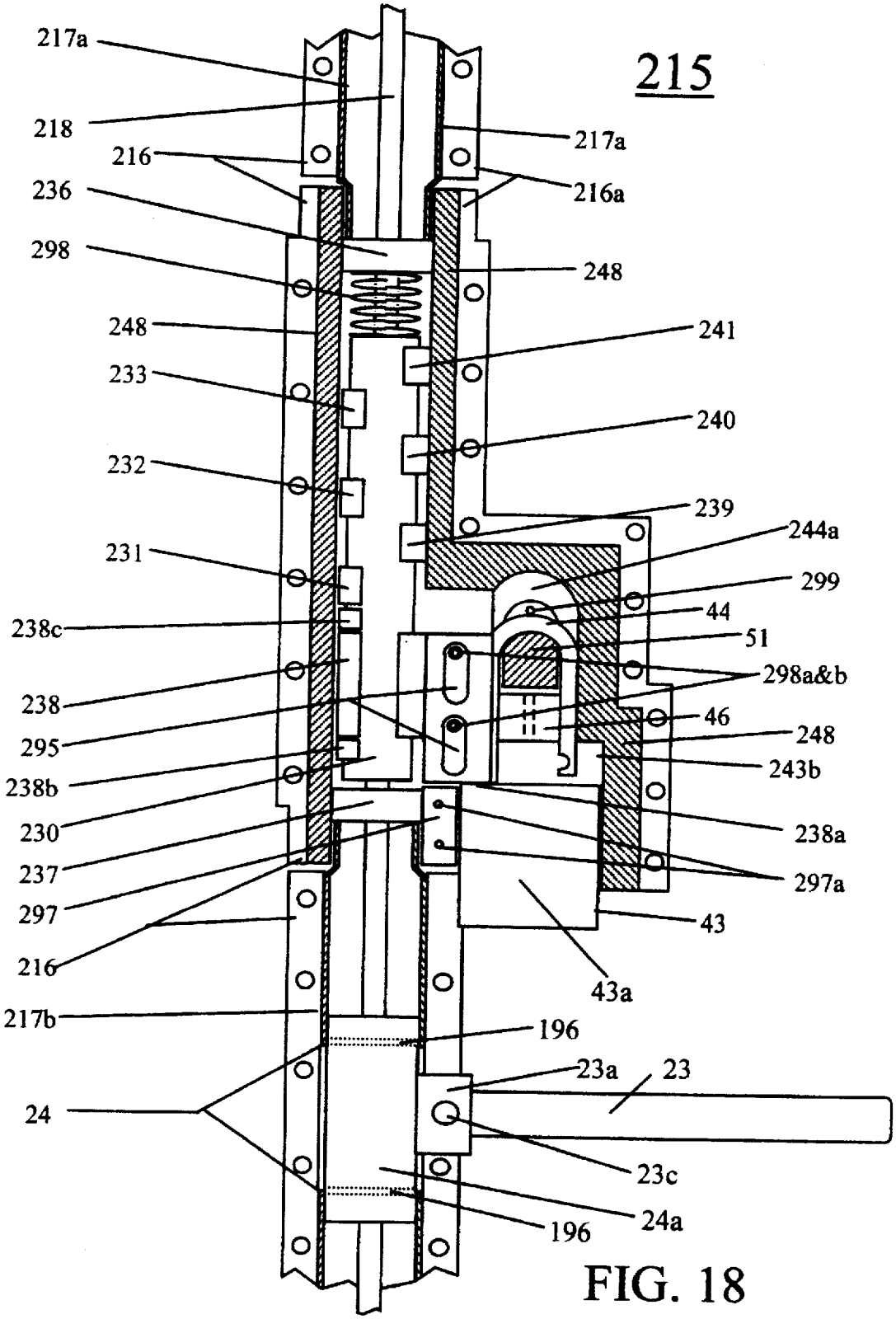
FIGS. 18 and 19 show a further embodiment of the invention in an unlocked and locked condition.

FIG. 18 illustrates a cut-away view of an additional embodiment, lock mechanism 215. Padlock 43 is unlocked and padlock body 43a is partially ejected from housing 248. Lock cylinder 230 is aligned to allow it to either be moved longitudinally to the locked position (see FIG. 19), or rotated clockwise to position lock rod 218 in the unlatched position. Retainers 238b and 238c are secured to lock cylinder 230 and insure that lock cylinder 230 moves longitudinally with component 238. Lock cylinder 230 can rotate relative to component 238. Slots 295 allow component 238 to move longitudinally with lock cylinder 230, relative to bolts with sleeves 298a and 298b. Tension produced by spring 298 pushing against bushing 236 and sliding lock cylinder 230 causes component 238, which is attached to component 230, to be held in constant contact with padlock body 43*a* at point 238*a*. As a result, any longitudinal movement of padlock body 43*a*, moves component 238, which results in an equal amount of longitudinal movement of lock cylinder 230. In the unlocked condition illustrated in FIG. 18, projections 231, 232, and 233, on lock cylinder 230 are free to intermesh between the fixed projections 239, 240, and 241 attached inside housing 248. Therefore, when lock cylinder 230 is free to rotate, lock rod 218, which is engaged by lock cylinder 230, can be rotated to disengage cam locks at each end of lock rod 218. Holes in flanges 216 and 216*a* are for insertion of tamperproof fasteners used to secure locking mechanism 215 to a door or the like. Opening 24 in housing 217*b* allows limited, rotational and longitudinal, movement of sleeve 24*a* with hinge support 23*a*. Housings 217*a*, 117*a* and 17*a* are interchangeable, as are housings 217*b*, 117*b* and 17*b*.

Figure 19:
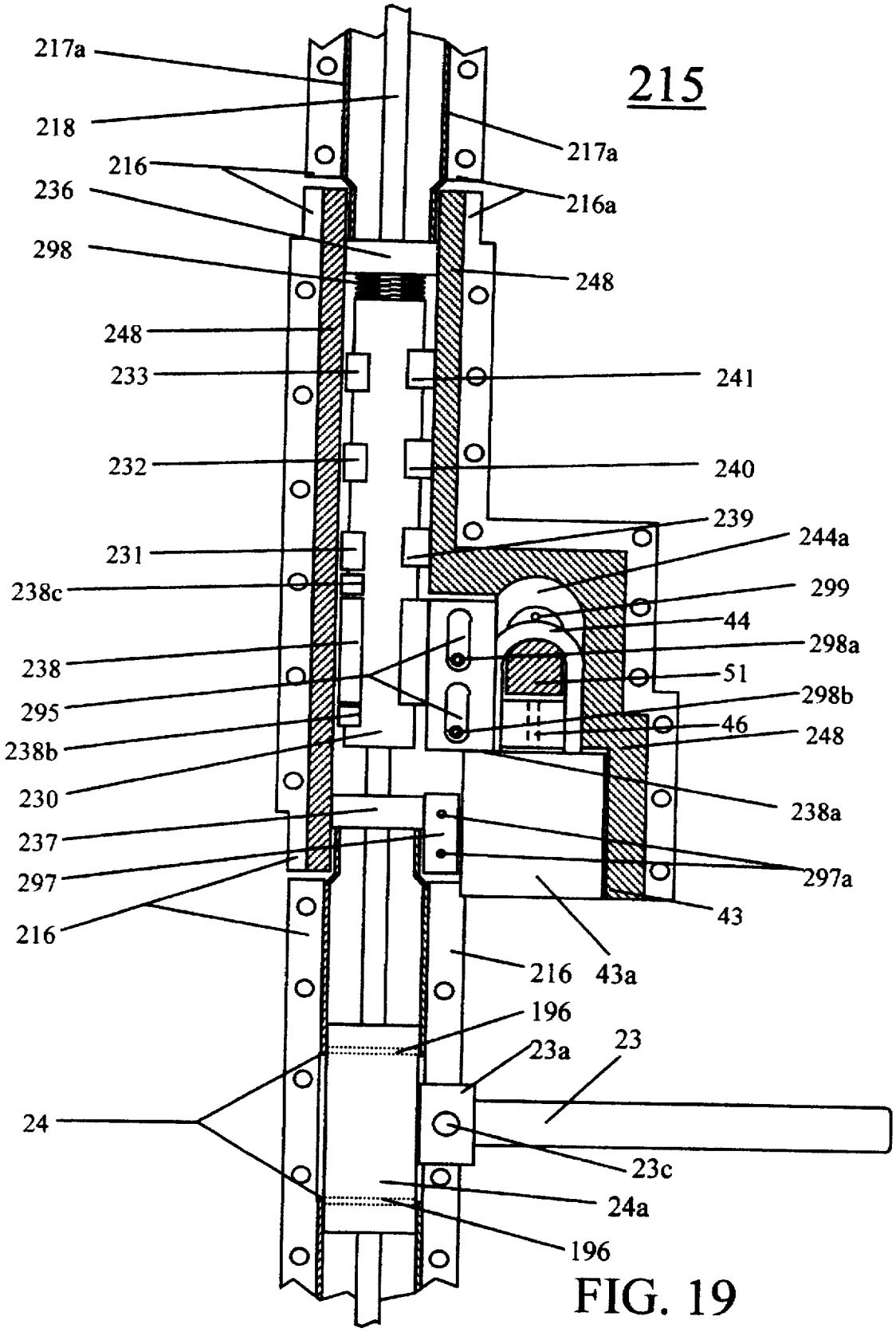

FIG. 19 illustrates a cut-away view of lock mechanism 215 in the locked condition. Padlock body 43*a* has been pushed into its housing and the padlock is in the locked condition. As a result lock cylinder 230 is positioned so that projections 231, 232 and 233, on sliding lock cylinder 230 engage the corresponding fixed projections 239, 240 and 241, which are attached inside of housing 248. Return spring 298 is compressed between bushing 236, which is secured to housing 248, and one end of lock cylinder 230. In the transition from the unlocked condition of FIG. 18 to the locked condition of FIG. 19, lock cylinder 230 slides freely in a longitudinal direction relative to lock rod 218. Since component 238 moves longitudinally when lock cylinder 230 moves longitudinally; tension produced by spring 298 pushing against lock cylinder 230, causes component 238 to be held in constant contact with the padlock body at point 238*a*. As a result, longitudinal movement of the padlock body 43*a* results in longitudinal movement of lock cylinder 230 relative to lock rod 218 and housing 248. Thus, when components of locking mechanism 215 are positioned as shown in FIG. 18; pushing padlock body 43*a* into its housing to its locked condition, results in lock cylinder 230 being positioned so that projections 231, 232 and 233 are aligned with fixed projections 239, 240 and 241. This blocks rotation of lock cylinder 230, which engages lock rod 218 and prevents lock rod 218 from turning. As a result, the cams at each end of lock rod 218 remain in the latched position.

FIG. 20 illustrates a cross-sectional cut across housing 248 at projection 241.

FIG. 21 illustrates a cross-sectional cut across lock cylinder 230 at projection 233.

FIG. 22 illustrates a cross-sectional cut across housing 248 at projection 233 on lock cylinder 230 and fixed projection 241 attached to housing 248. Projection 233 on lock cylinder 230 is in the unlocked position.

FIG. 23 illustrates a cross-sectional view of housing 248 at projection 233 on lock cylinder 230, and fixed projection 241 attached to housing 248. Projection 233 is aligned to engage projection 241 and lock rod 218 can not be rotated.

Figure 24:
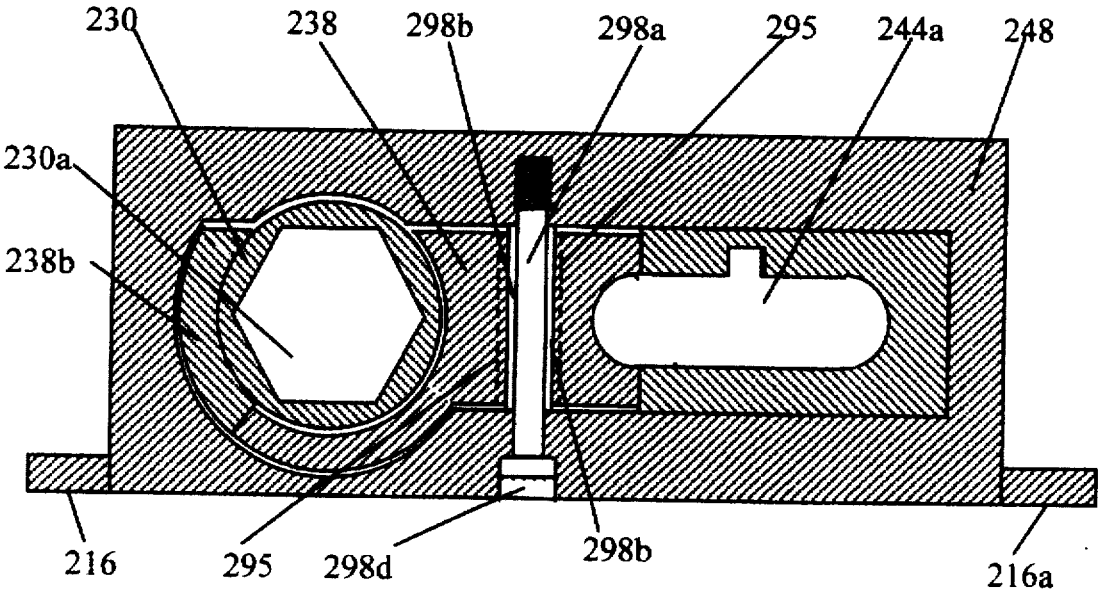
FIG. 24 shows a cross-section view of the locking cylinder and lock housing.

FIG. 24 illustrates a cross-sectional view of housing 248 at component 238. Sliding lock cylinder 230 is free to rotate in relation to component 238. Bolt 298*a* is inserted through recessed hole 298*d* and sleeve 298*b*. Sleeve 298*b* provides resistance to crushing. Slot 295 is designated by dotted lines which are aligned parallel with bolt 298*a*. Opening 244*a* receives padlock shackle 44 and filler 46.

Figure 25:
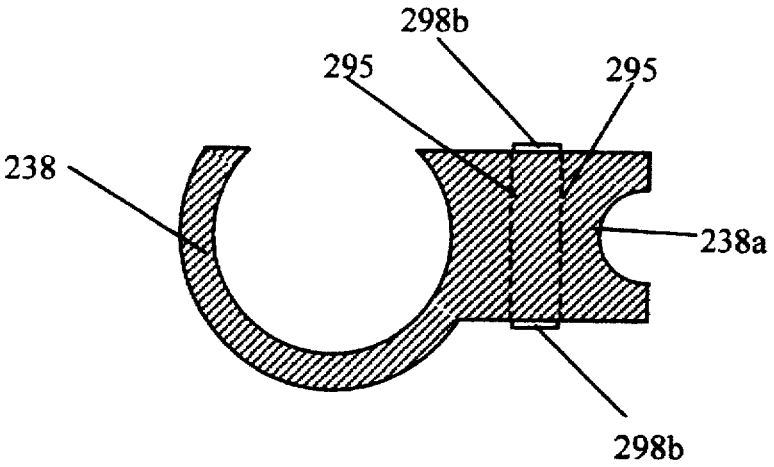
FIG. 25 shows a cross-sectional view of one of the locking components.

FIG. 25 illustrates a cross-sectional view of component 238 with sleeve 298*b*. Sleeve 298*b* extends from slot 295 of component 238. Groove 238*a* slides along one leg of padlock shackle 44.

Figure 26:
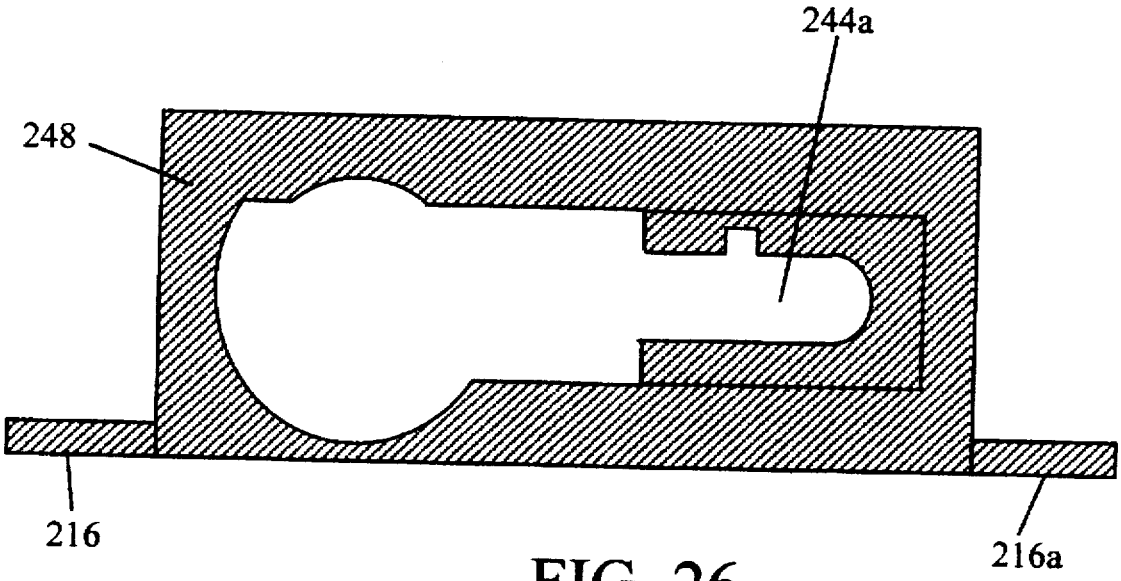
FIG. 26 shows a cross-section view of the locking cylinder and lock housing without the lock and locking cylinder.

FIG. 26 illustrates the same cross-sectional cut across housing 248 as illustrated in FIG. 24, however all component parts have been removed.

It has been shown that in some embodiments that the lock mechanism lock moves longitudinally, however, the lock mechanism does not move longitudinally in other embodiments. This is a matter of design of the lock mechanism. Similarly, the lock shank is straight in some embodiments, but may be circular, depending upon the lock housing design.

What is claimed:

1. A cam locking rod device for securing doors on intermodal cargo containers, semi-trailers, utility trailers, trucks, and other similar cargo storage compartments, comprising:

a rotatable cam lock rod, having cam locks on each end, adapted to be mounted on a container door;

a locking cylinder, through which the cam lock rod extends, having at least one locking projection thereon;

a sliding latch having at least one projection thereon for interacting with the at least one projection on the locking cylinder;

a lock having a shoulder adjacent to and in movable contact with the sliding latch;

a spring in contact with the sliding latch biasing the sliding latch in a position in which the at least one projection thereon is in a non-meshed relation to the at least one projection on the locking cylinder;

whereby, when the lock is placed in a locked condition, the lock moves the sliding latch against the bias of said spring, and the projections thereon into a locked position with the projections on the locking cylinder preventing rotation of the cam lock rod.

2. The cam locking rod device according to claim 1, including a protective cover mounted over the cam locking rod device.

3. The cam locking rod device according to claim 1, including a flanged housing which houses the sliding latch, spring and lock.

4. The cam locking rod device according to claim 3, wherein the lock is a pad lock with a pad lock shackle, and the pad lock is held in the flanged housing by a retainer block around which the pad lock shackle extends.

5. The cam locking rod device according to claim 1, wherein the cam lock rod and cam locks on each end of the cam lock rod are rotated into and out of a locked position by a handle secured to the cam lock rod, and rotation of the cam lock rod is prevented when the lock is in a locked condition.

6. The cam locking rod device according to claim 1, wherein there are a plurality of projections on each of the locking cylinder and sliding latch, and locking of the lock moves the projections into an interlocking position such that the cam lock rod will not rotate.

7. The cam locking rod device according to claim 2, wherein the protective cover is adapted to extend around the edge of a door on which the cam locking rod device is mounted.

8. A cam locking rod device for securing doors on intermodal cargo containers, semi-trailers, utility trailers, trucks, and other similar cargo storage compartments, comprising:

a rotatable cam lock rod, having cam locks on each end, adapted to be mounted on a container door for securing the container door in a locked condition;

a locking cylinder, through which the cam lock rod extends, having at least one locking projection thereon;

sliding latch having at least one projection thereon for interacting with the at least one projection on the locking cylinder;

a pad lock having a shoulder adjacent to and in movable contact with the sliding latch;

a spring in contact with the sliding latch biasing the sliding latch against the pad lock shoulder and in a position in which the at least one projection thereon is in a non-meshed relation to the at least one projection on the locking cylinder;

whereby when the pad lock is placed in a locked condition, the lock shoulder moves the sliding latch against the bias of said spring, and the at least one projection thereon into a locked position with the at least one projection on the locking cylinder preventing rotation of the cam lock rod.

9. The cam locking rod device according to claim 8, including a protective cover mounted over the cam locking rod device.

10. The cam locking rod device according to claim 8, including a flanged housing which houses the sliding latch, spring and pad lock.

11. The cam locking rod device according to claim 10, wherein the pad lock includes a pad lock shackle, and the pad lock is held in the flanged housing by a retainer block around which the pad lock shackle extends.

12. The cam locking rod device according to claim 8, wherein the cam lock rod and cam locks on each end of the cam lock rod are rotated into and out of a locked position by a handle secured to the cam lock rod, and rotation of the cam lock rod is prevented when the pad lock is in a locked condition.

13. The cam locking rod device according to claim 8, wherein there are a plurality of projections on each of the locking cylinder and sliding latch, and locking of the pad lock moves the projections into an interlocking position such that the cam lock rod will not rotate.

14. The cam locking rod device according to claim 9, wherein the protective cover is adapted to extend around the edge of a door on which the cam locking rod device is mounted.

* * * * *